US009228334B2

(12) United States Patent
Yu et al.

(10) Patent No.: US 9,228,334 B2
(45) Date of Patent: Jan. 5, 2016

(54) LIQUID-OPERATED ACTUATOR ASSEMBLY, PARTICULARLY FOR A FLUSH TOILET, AND FLUSH TOILET INCORPORATING THE ASSEMBLY

(75) Inventors: Kwok Chiu Yu, Hong Kong (CN); Kai Chi Chan, Hong Kong (CN); Alec Kam Lek Quan, Hong Kong (CN)

(73) Assignee: DEFOND COMPONENTS LIMITED, Chai Wan, Hong Kong, SAR (CN)

( * ) Notice: Subject to any disclaimer, the term of this patent is extended or adjusted under 35 U.S.C. 154(b) by 522 days.

(21) Appl. No.: 13/459,802

(22) Filed: Apr. 30, 2012

(65) Prior Publication Data

US 2013/0152293 A1 Jun. 20, 2013

Related U.S. Application Data

(63) Continuation-in-part of application No. 13/330,108, filed on Dec. 19, 2011, now abandoned.

(51) Int. Cl.
*E03D 5/12* (2006.01)
*E03D 5/02* (2006.01)
*F15B 13/044* (2006.01)
(Continued)

(52) U.S. Cl.
CPC ..... *E03D 5/024* (2013.01); *A47K 13/10* (2013.01); *E03D 5/10* (2013.01); *F15B 11/08* (2013.01); *F15B 13/044* (2013.01); *F15B 2211/3052* (2013.01); *F15B 2211/3056* (2013.01); *F15B 2211/3138* (2013.01);
(Continued)

(58) Field of Classification Search
CPC ..... F15B 13/044; F15B 2211/41554; A47K 13/10; E03D 5/024; E03D 5/10
USPC ..... 4/405–407, 380; 251/30.01, 65; 137/109; 91/433, 442, 443, 459
See application file for complete search history.

(56) References Cited

U.S. PATENT DOCUMENTS 2,219,044 A 10/1940 Horr
2,744,262 A * 5/1956 Ritter ..... 4/407
(Continued)

FOREIGN PATENT DOCUMENTS

DE 103 00 931 A1 7/2004
FR 2 916 773 A1 12/2008
WO WO 2006/046208 A1 5/2006

OTHER PUBLICATIONS

European Patent Office; Search Report in European Patent Application No. 12 19 7578 (Sep. 2, 2014).

*Primary Examiner* — Lauren Crane
*Assistant Examiner* — Erin Deery
(74) *Attorney, Agent, or Firm* — Leydig, Voit & Mayer, Ltd.

(57) ABSTRACT

A fluid-operated actuator assembly has a valve with an inlet for connection to a pressurized fluid source, a bi-stable electromagnetic device for operating the valve, which has a first state closing the valve and a second state opening the valve, a hydraulic actuator, and an electronic control circuit. The hydraulic actuator has an actuating member in a housing, the housing having a chamber on one side of the actuating member to which an outlet of the valve is connected for receiving fluid from the fluid source when the valve is opened, the actuating member for operation of the hydraulic actuator. The control circuit momentarily energizes the bi-stable electromagnetic device to the hydraulic actuator from the second state, back to the first state, to terminate operation of the hydraulic actuator.

9 Claims, 28 Drawing Sheets

(51) Int. Cl.
*F15B 11/08* (2006.01)
*A47K 13/10* (2006.01)
*E03D 5/10* (2006.01)

(52) U.S. Cl.
CPC ..... *F15B 2211/31558* (2013.01); *F15B 2211/41554* (2013.01); *F15B 2211/7052* (2013.01)

(56) References Cited

U.S. PATENT DOCUMENTS 3,780,384 A 12/1973 Rivelle
3,999,223 A * 12/1976 Sievers ..... 4/325
4,291,422 A 9/1981 Shoemaker et al.
4,756,031 A * 7/1988 Barrett ..... 4/407
5,279,322 A 1/1994 Nakamura et al.
6,164,322 A * 12/2000 Najmolhoda et al. ..... 137/540
RE41,394 E * 6/2010 Bugge et al. ..... 600/16
8,091,155 B1 * 1/2012 Sanchez ..... 4/246.1
2003/0234377 A1 12/2003 Herbert et al.
2004/0051064 A1 * 3/2004 Beraldo ..... 251/30.03
2005/0278842 A1 * 12/2005 Yen ..... 4/406
2006/0242755 A1 11/2006 Lohss
2008/0178374 A1 * 7/2008 Abrams ..... 4/246.2
2009/0211009 A1 * 8/2009 Yen ..... 4/407
2010/0306910 A1 * 12/2010 Chen ..... 4/246.1
2013/0318696 A1 12/2013 Gomez Espana Collignon

* cited by examiner

LIQUID-OPERATED ACTUATOR ASSEMBLY, PARTICULARLY FOR A FLUSH TOILET, AND FLUSH TOILET INCORPORATING THE ASSEMBLY

The present invention relates to a fluid-operated actuator assembly which is particularly, but not exclusively, suitable for use in connection with sanitary wares such as a toilet.

BACKGROUND OF THE INVENTION

Battery-operated actuator assembly is known for use in controlling the flow of water in the toilet. Taking as an example, automatic facets will, upon detection of the hands of a user, open and supply water for a certain period of time. These faucets are operated by battery cells. As the power consumption is generally not low, the battery life is usually short and hence replacement of battery cells can be frequent.

The invention seeks to mitigate or to at least alleviate such a problem or shortcoming by providing a fluid-operated actuator assembly.

SUMMARY OF THE INVENTION

According to a first aspect of the invention, there is provided a fluid-operated actuator assembly comprising a valve having an inlet and an outlet, the inlet being for connection to a pressurized fluid source, a bi-stable electromagnetic device for operating the valve, the bi-stable electromagnetic device having a first state closing the valve and a second state opening the valve, a hydraulic actuator, and an electronic control circuit. The hydraulic actuator comprises an actuating member in a housing, the housing having a chamber on one side of the actuating member to which the outlet of the valve is connected for receiving fluid from a said fluid source when the valve is opened by the bi-stable electromagnetic device in order to act upon and move the actuating member for operation of the hydraulic actuator. The electronic control circuit is for momentarily energizing the bi-stable electromagnetic device to change it from the first state to the second state to enable operation of the hydraulic actuator and subsequently from the second state back to the first state to terminate operation of the hydraulic actuator.

Preferably, the bi-stable electromagnetic device comprises a latching solenoid.

Preferably, the actuating member comprises a piston which is movable within the housing.

In a preferred embodiment, the housing has a cylindrical interior with a central axis, and the piston is angularly movable about the central axis.

It is preferred that the hydraulic actuator comprises a hydraulic motor.

In a preferred embodiment, the housing has a cylindrical interior with a central axis, and the piston is movable linearly along the central axis.

More preferably, the piston is freely slidable, with or without bias, in opposite directions along the housing.

It is preferred that the hydraulic actuator comprises a hydraulic cylinder.

In a preferred embodiment, the actuating member is arranged to be acted upon and moved by said fluid from an inoperative position to an operative position member for operation of the hydraulic actuator and to be held in the operative position.

More preferably, the chamber includes a pressure limiter for limiting pressure of fluid received in the chamber acting upon the actuating member.

Further more preferably, the pressure limiter comprises a leak in the housing positioned for exposure to the chamber when the actuating member reaches the operative position.

Yet further more preferably, the leak is provided by a hole through a wall of the housing.

Yet further more preferably, the fluid-operated actuator assembly includes a reservoir for collecting said fluid leaking out through the leak.

It is preferred that said fluid received in the chamber is arranged to be flowing through the chamber while exerting a non-static pressure upon the actuating member when the actuating member reaches the operative position.

It is preferred that the fluid-operated actuator assembly includes a draining device for draining said fluid from the chamber upon termination of operation of the actuating member, as the actuating member returns to the inoperative position.

It is further preferred that the draining device comprises a spring-loaded valve.

It is yet further preferred that the spring-loaded valve is connected to permit flow of fluid along one of two paths and is arranged to be opened for a first path and closed for a second other path or closed for the first path and opened for the second other path It is preferred that the draining device is provided in a path running between the valve and the housing.

It is preferred that the valve includes a pilot valve.

Advantageously, the electronic control circuit includes a switching component for operating the bi-stable electromagnetic device.

In a preferred embodiment, the electronic control circuit is battery-operated.

According to a second aspect of the invention, there is provided a toilet cistern incorporating the aforesaid fluid-operated actuator assembly, including a body acting as a reservoir for holding water for flushing, and a flushing mechanism comprising a flushing valve located at a bottom of the body for flushing water held in the body. The flushing valve is operable upon being lifted by a driving force from the actuating member as the actuating member is moved by said fluid.

Preferably, the flushing valve is coupled to the actuating member by means of a motion converter which converts the motion of the actuating member into an upward motion for lifting the flushing valve.

Preferably, the actuating member is arranged to support partially the weight of the flushing valve when the actuating member is moving from the inoperative position to the operative position while lifting the flushing valve, and later to return to the inoperative position under the action of the weight of the flushing valve.

According to a third aspect of the invention, there is provided a toilet incorporating the aforesaid toilet cistern, including a toilet bowl to which the toilet cistern is close coupled.

According to a fourth aspect of the invention, there is provided a toilet incorporating the aforesaid fluid-operated actuator assembly, including a toilet bowl, a lid for the toilet bowl, and a connecting member connecting the lid on the toilet for movement between a closed position and an open position. The lid is arranged to be opened or closed by a driving force from the actuating member as the actuating member is moved by said fluid.

Preferably, the toilet includes a gear system provided between the actuating member and the lid for transmitting the driving force from the actuating member to the lid.

More preferably, the gear system is adapted to transmit the driving force to move the lid between the closed and open positions and to flip the lid to have its underside facing to the back in the open position.

More preferably, the gear system is physically associated with the connecting member.

Further more preferably, the connecting member is elongate having two opposite ends, with one end connected relative to the toilet bowl and the opposite end connected to the lid.

Yet further more preferably, the gear system is provided inside the connecting member.

It is preferred that the gear system comprises a plurality of gears and a belt disposed on a plurality of axles.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
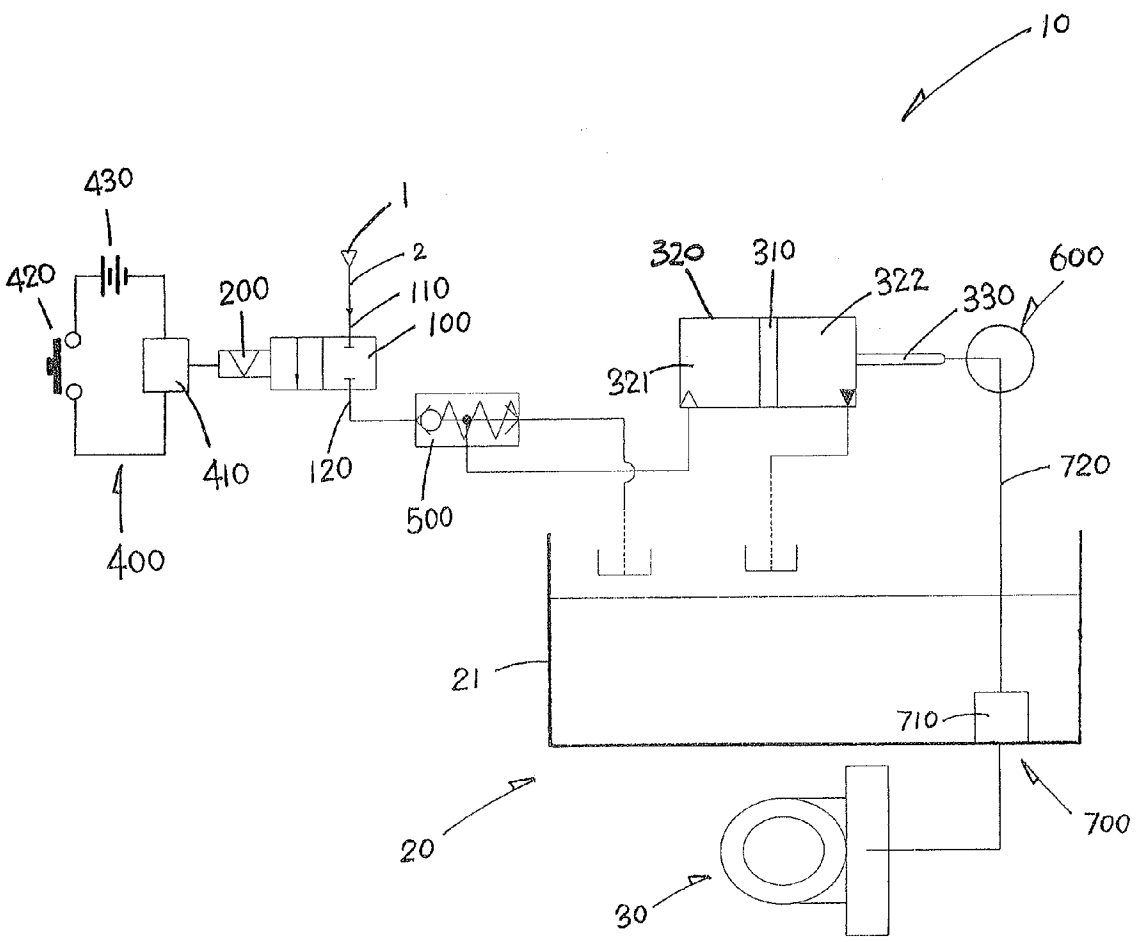
FIG. 1 is a schematic diagram of an embodiment of a fluid-operated actuator assembly in accordance with the invention, which is installed for operation in the cistern of a toilet.

Referring to FIGS. 1 to 15A of the drawings, there is shown a fluid-operated actuator assembly 10 which is installed in a cistern 20 of a flush toilet, both employing the invention. The actuator assembly 10 comprises a valve 100 having an inlet 110 and an outlet 120, a bi-stable electromagnetic device 200 for operating the valve 100, a hydraulic actuator 300, and an electronic control circuit 400 for energizing the electromagnetic device 200. The valve inlet 110 is for (direct or indirect) connection to a pressurized water source e.g. domestic tap or flush water source 1 by means of a pipe 2 for supply of water to operate the hydraulic actuator 300.

The electromagnetic device 200 is preferably implemented by a bi-stable or latching solenoid 200 having a first state closing the valve 100 and a second state opening the valve 100. The latching solenoid 200 has a cylindrical iron casing 210, a solenoid coil 220 co-axially within the casing 210 and, along a central axis of the casing 210, a pole piece 240, a permanent magnet 230 located between the casing 210 and an inner end of the pole piece 240, and a spring-loaded plunger 250 adjacent an outer end of the pole piece 240. The plunger 250 is resiliently biased by a coil spring 260 compressed between the plunger 250 and the pole piece 240, at a small distance off the pole piece 240 in an unlatched position. The permanent magnet 230 has a magnetic field which is in line with that of the solenoid coil 220 in one polarity but counteracted by the coil's magnetic field in the reversed polarity.

In operation, when the solenoid coil 220 is triggered or energized (e.g. by a positive electrical pulse) in the same polarity as the permanent magnet 230, the plunger 250 will be attracted to slide towards and to bear against the pole piece 240, counteracting the spring 260, through a very short stroke and stay in such a latched position, i.e. the second state holding the valve 100 open, even if the energizing voltage is switched off. At a later time, after say 6 to 9 seconds, when the solenoid coil 220 is energized in the reversed polarity (e.g. by a negative electrical pulse), its magnetic field will counteract and neutralize the magnetic field of the permanent magnet 230, thereby releasing the plunger 250, which will then return to its original unlatched position, i.e. the first state holding the valve 100 closed, under the action of the spring 260.

The latching solenoid 200 normally stays in the first state, without consuming any electrical power, to hold the valve 100 normally closed. The latching solenoid 200 will upon a brief electrical trigger change to the second state to open the valve 100 and hold it open without power consumption, until the next trigger in the opposite polarity is applied.

The valve 100 is hereinafter referred to as the main valve 100, which is operated by the latching solenoid 200 via a considerably smaller and less powerful pilot valve 90 which is installed immediately in front of the plunger 250.

The pilot valve 90 is formed by a valve member 91 embedded in the plunger 250 and a valve seat 92 with which the valve member 91 normally seals. Externally, the pilot valve 90 has an inlet 93 and an outlet 94 which are in communication with each other via a passage 93-94 through the valve seat 92 such that the passage 93-94 is controlled by the pilot valve 90 and in turn by the latching solenoid 200. The pilot valve 90 normally shuts the passage 93-94 to in turn close and keep the main valve 100 normally closed.

As to construction, the main valve 100 is formed by a valve member 101 with which a valve seat 102 normally seals, and includes a cylindrical core 130 whose one end 131 acts as the valve seat 102 and opposite end 132 leads to the main valve outlet 120. The valve member 101 is a flat rubber disc which, while normally bearing flat against and hence sealing with the valve seat 102, has a flexible periphery 101A of a reduced thickness and bent cross-section such that the valve member 101 is retractable to disengage from the valve seat 102.

The valve member 101 extends across the interior of the main valve 100 and divides the same into a front interior or chamber 100A and a rear interior which is further divided by the cylindrical core 130 into an outer chamber 100B surrounding the core 130 and an inner chamber 100C within the core 130. The front chamber 100A is in communication with the inlet 93 of the pilot valve 90, and the outer and inner chambers 100B and 100C in communication with the main valve inlet 110 and outlet 120 respectively. The outlet 94 of the pilot valve 90 is connected to the main valve outlet 120.

Figure 5:
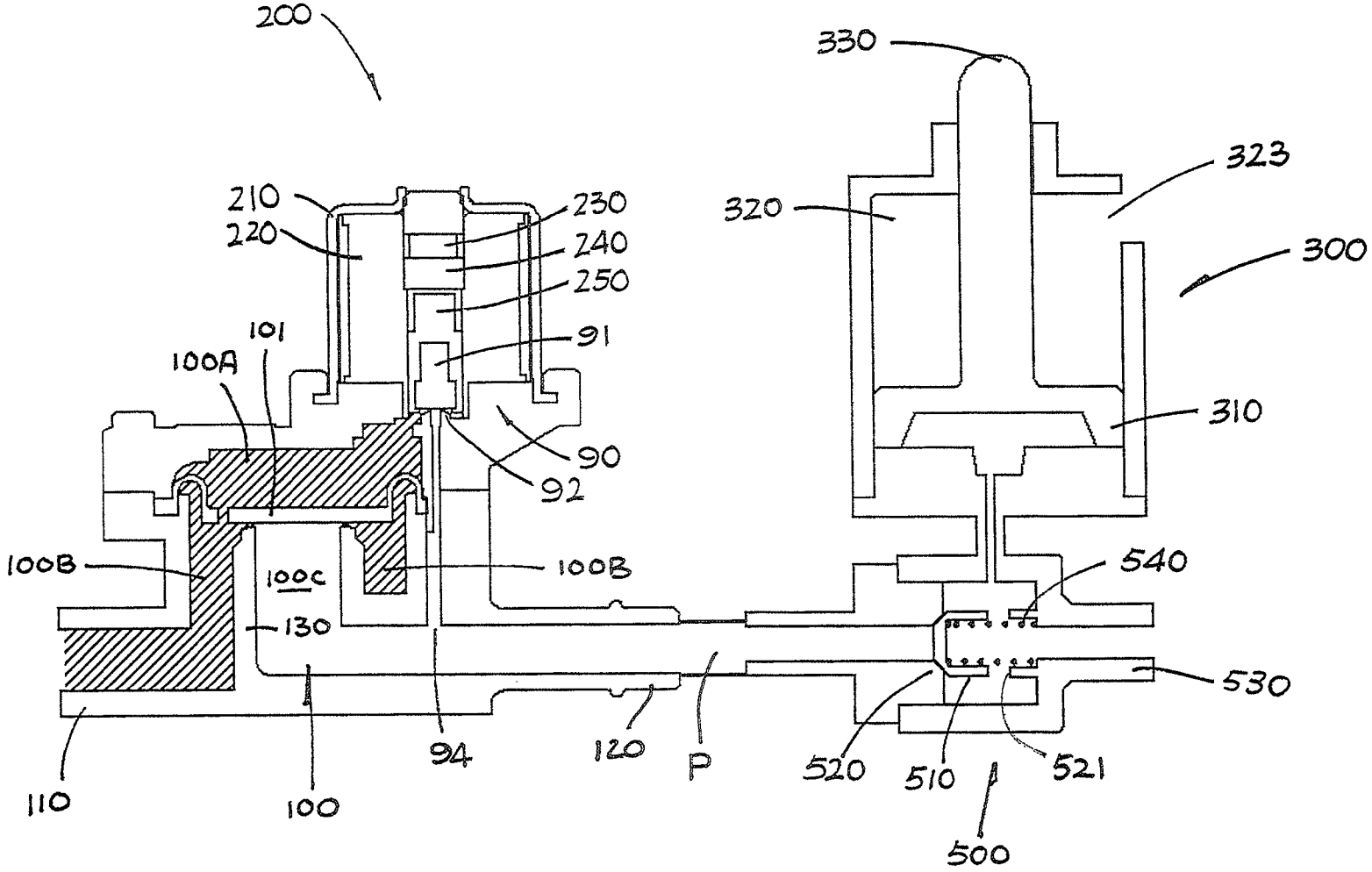
FIGS. 5 to 13 are schematic cross-sectional views equivalent to FIG. 4, showing sequential conditions during operation of the fluid-operated actuator assembly.

A small hole 101B through the valve member 101 equalizes the pressure between the front and outer chambers 100A and 100B when the pilot valve 90 is closed holding water in the front chamber 100A. In this condition, water fed from the water source 1 into the outer chamber 100B (and also into the front chamber 100A through the hole 101B) is blocked against flowing into the inner chamber 100C by the valve member 101 in sealing engagement with the valve seat 102, i.e. when the main valve 100 is closed (FIG. 5).

Figure 6:
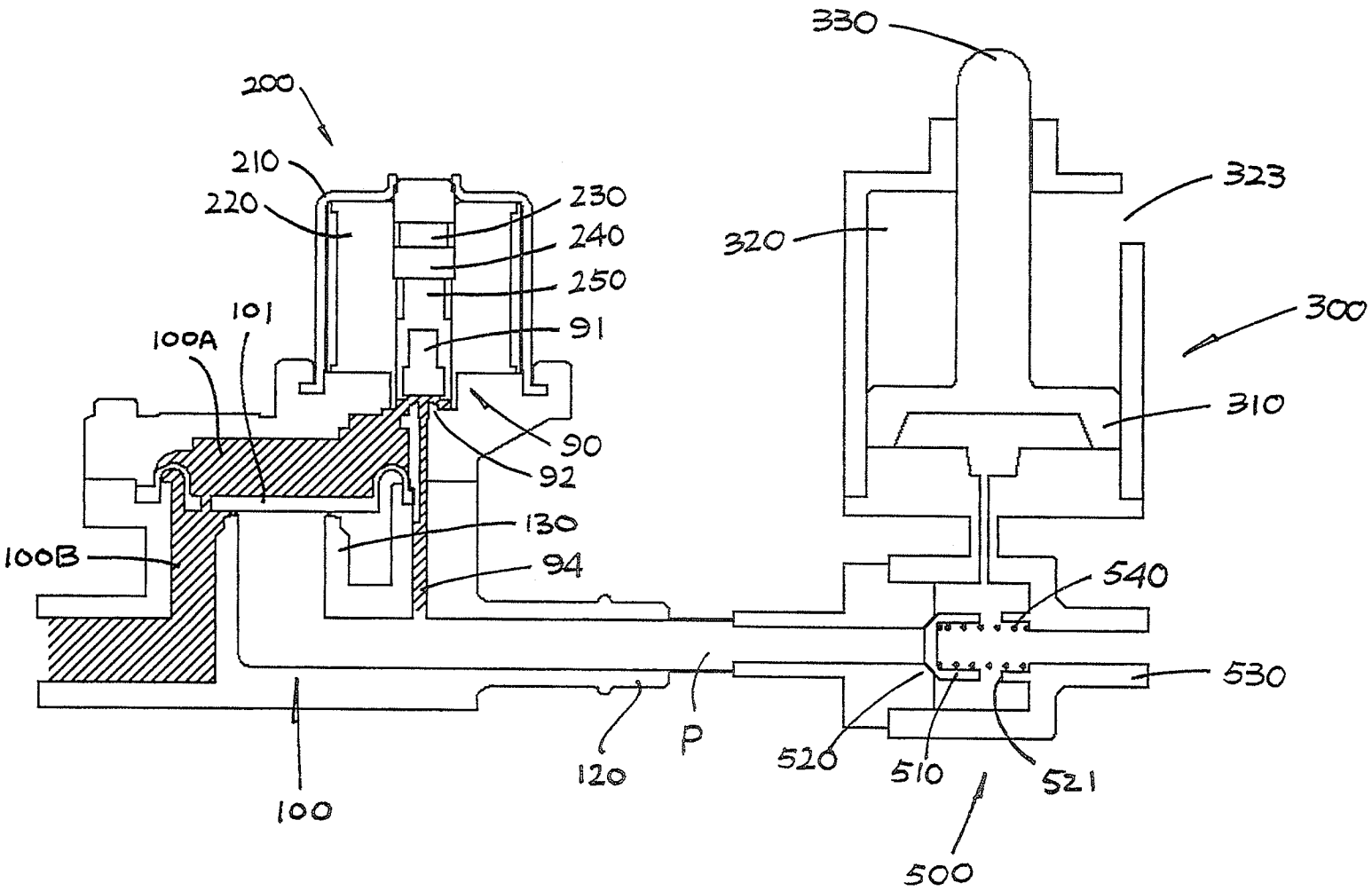

Upon energization, the latching solenoid 200 opens the pilot valve 90, and this results in loss of water from the front chamber 100A via the pilot valve 90 and hence pressure drop in the front chamber 100A (FIG. 6). The lost water flows from the outlet 94 of the pilot valve 90 to the main valve outlet 120 for downstream operation.

Figure 7:
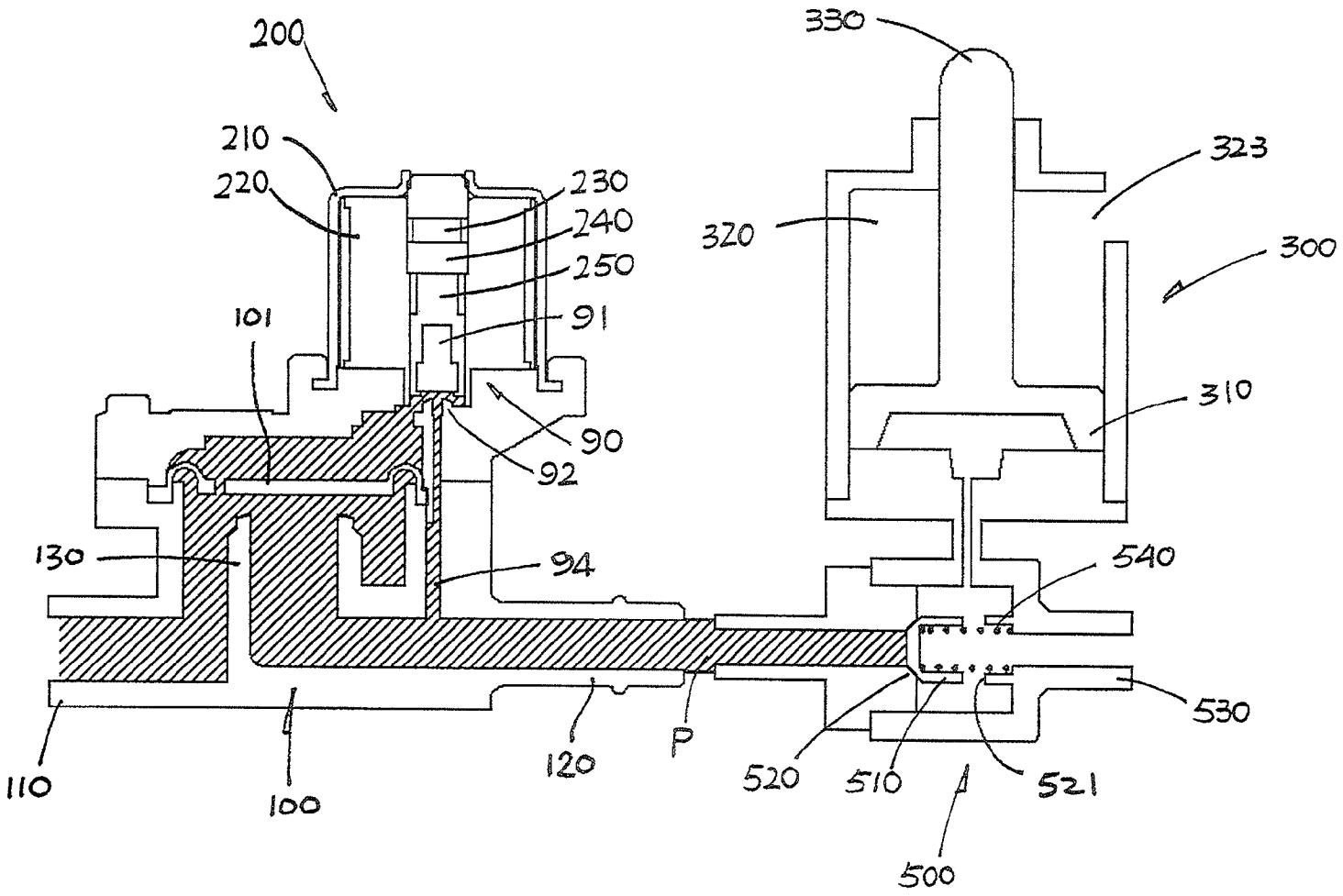

With water being fed into the outer chamber 100B via the inlet 110 of the main valve 100, the pressure in the outer chamber 100B substantially maintains and hence becomes relatively higher than that in the front chamber 100A. The valve member 101 consequently retracts and disengages from the valve seat 102, thereby giving way to let water from the outer chamber 100A flow into the inner chamber 100C and then out of the main valve 100 via its outlet 120 (FIG. 7). The main valve 100 is thus opened.

The main valve 100 controls the main flow of water from the water source 1 to operate the hydraulic actuator 300, at a relatively high pressure or high flow feed. The pilot valve 90 is a smaller valve that controls a limited-flow control feed to the main valve 100, thereby allowing a small and easily operated feed to control a much higher pressure or higher flow feed, which would otherwise require a much larger force to operate. The pilot valve 90 is used to enable the use of a relatively less powerful latching solenoid 200.

Alternatively, in a slightly different embodiment of the subject fluid-operated actuator assembly of a simpler construction, a relatively more or sufficiently powerful latching solenoid (200) may be employed to directly operate the main valve (100) for controlling the main flow of water, thereby eliminating use of the pilot valve (90).

As to the hydraulic actuator 300, it may be implemented by a hydraulic cylinder as in this embodiment, which is also designated by reference numeral 300, or alternatively a hydraulic motor in a latter embodiment. A hydraulic cylinder is a mechanical actuator that is used to give a unidirectional force through a unidirectional stroke, also known as a linear hydraulic motor. A hydraulic motor is a mechanical actuator that converts hydraulic pressure and flow into torque and angular displacement i.e. rotation, and is the rotary counterpart of a hydraulic cylinder.

In passing, it is noteworthy that any other suitable forms of hydraulic actuator may be employed, dependent upon the required type of actuating motion, input/output power and physical size, etc.

The hydraulic cylinder 300 has an actuating member, which is typically a piston 310, movably mounted in a barrel or housing 320 having a cylindrical interior with a central axis. The piston 310 is in sealed but sliding engagement within the housing 320. The housing 320 is oriented with its central axis extending horizontally (see e.g. FIG. 14). The piston 310 is freely slidable, under no specific biasing force (for simplicity and as is unnecessary in this embodiment), in opposite directions, co-axially and linearly along the central axis of the housing 320.

It is intended that a certain degree of bias may be included for the piston 310, e.g. by using an extension or torsion spring, when the operation warrants it e.g. to provide an adequate force for return of the piston 310.

The piston 310 includes a rod 330 as the point of actuation, which projects forward from the piston 310 along its central axis and out through a front end of the housing 320. The housing 320 has a front chamber 322 on one or the front side of the piston 310 as the rod 330 and a rear chamber 321 on the rear side of the piston 310 opposite the rod 330. The outlet 120 of the main valve 100 is connected indirectly by means of a pipeline P (or directly) to, or generally stated in communication with, the chamber 321 for receiving water flowing from the water source 1 via the main valve 100 when the main valve 100 is opened by the latching solenoid 200, such that the water acts upon and moves the piston 310 for operation of the hydraulic cylinder 300.

Water entering the rear chamber 321 acts upon the piston 310 for moving the piston 310 and in turn extending the rod 330 forward from an inner inoperative position to an outer operative position, thereby performing a push action, and for subsequently holding the rod 330 in the operative position i.e. extended.

The housing 320 has a linear slot 323 generally in the front chamber 322, which extends axially at the lowest position of the housing's horizontally-lying cylindrical wall. The slot 323 extends from its one end situated at the front end of the housing 320 for a certain length greater than the (effective) thickness of the piston 310 such that its other end 323X will be exposed to the rear chamber 321 right behind the piston 310 when the piston 310 is pushed by water in the rear chamber 321 sufficiently forward along the housing 320, where it locates the rod 330 in the latter's operative position. The slot's exposed end 323X is a hole that represents a leak through the housing's wall for the rear chamber 321, when the rod 330 reaches its operative position.

Upon exposure of such a leak to the rear chamber 321, the water in the chamber 321 finds its way out of the housing 320. The leak is of an optimum size, i.e. not too large and not too small, just sufficient to limit the pressure of the water in the rear chamber 321 acting upon the piston 310 at a certain level while water is being continuously replenished from the water source 1 via the main valve 100 and flowing through the rear chamber 321. While flowing in the rear chamber 321, the water exerts a non-static pressure upon the piston 310 when the rod 330 reaches its operative position, which is sufficient to keep the rod 330 in the operative position.

The leak acts as a pressure limiter for water in the rear chamber 321 of the housing 320. It avoids over-pressure in the rear chamber 321, which otherwise may thrust the piston 310 too hard against the front end of the housing 320 or shatter the housing 320. Apart from protecting the hydraulic cylinder 300, the pressure limiter also improves the response time during return of the piston 310. The pressure limiter is an enhancement feature.

The control circuit 400 is implemented by an MCU 410 and may include an electrical triggering device which may be provided by, for example, a pushbutton switch or a remote sensor 420 for triggering the control circuit 400 to operate, and is battery-operated by one or more battery cells 430. The MCU 410 has an output pin connected to an electronic or solid-state switching component, such as a BJT transistor or MOSFET, for controlling the latching solenoid 200 by momentarily applying an electrical signal via the switching component to the latching solenoid 200 in order to change it from the first state (closing the main valve 100) to the second state (opening the main valve 100) thereby triggering the operation of the rod 330 and, subsequently after a predetermined period of time of operation has elapsed (e.g. 10 seconds) with a second electrical signal to change the latching solenoid 200 from the second state back to the first state for terminating the operation of the rod 330.

The first electrical signal may be a positive electrical pulse, and the second electrical signal a negative electrical pulse, both having a pulse width of about 20 ms (millisecond). The duration of the electrical pulses is sufficiently long (say at least 5 ms) for the valve member 101 of the main valve 100 to respond (i.e. changing position relative to the valve seat 102) to the opening/closing of the pilot valve 90.

The rod 330 is arranged to return to its original inoperative position, i.e. to recede, upon expiration of the aforesaid predetermined period of time of operation. The rod 330 is only able to recede when the water behind the piston 310 gives way or, for example, is drained as in the case of the described embodiment. A draining device 500 is employed for this purpose, which kicks in upon termination of operation of the rod 330, as the rod 330 returns or is returning to the inoperative position.

The draining device 500 is a spring-loaded valve as provided by a shuttle valve 500 provided in a path running between the main valve 100 and the housing 320 of the hydraulic cylinder 300. The shuttle valve 500 is formed by a valve member 510 reciprocating between a first valve seat 520 in communication with the main valve outlet 120 and a second valve seat 521 in communication with a drain hole 530, with the valve member 510 being biased by a coil spring 540 to normally seal with the first valve seat 520, off the second valve seat.

Hence the shuttle valve 500 is normally closed for the main valve outlet 120 and normally open for the drain hole 530. Upon opening for the main valve outlet 120, the shuttle valve 500 closes for the drain hole 530, and vice versa. In general, the shuttle valve 500 is connected to permit flow of fluid along one of two paths and is arranged to be opened for a first path and closed for a second other path or conversely closed for the first path and opened for the second other path. Specifically, the shuttle valve 500 allows fluid to flow past it along one of two paths associated with the main valve outlet 120 and the drain hole 530 respectively.

Figure 8:
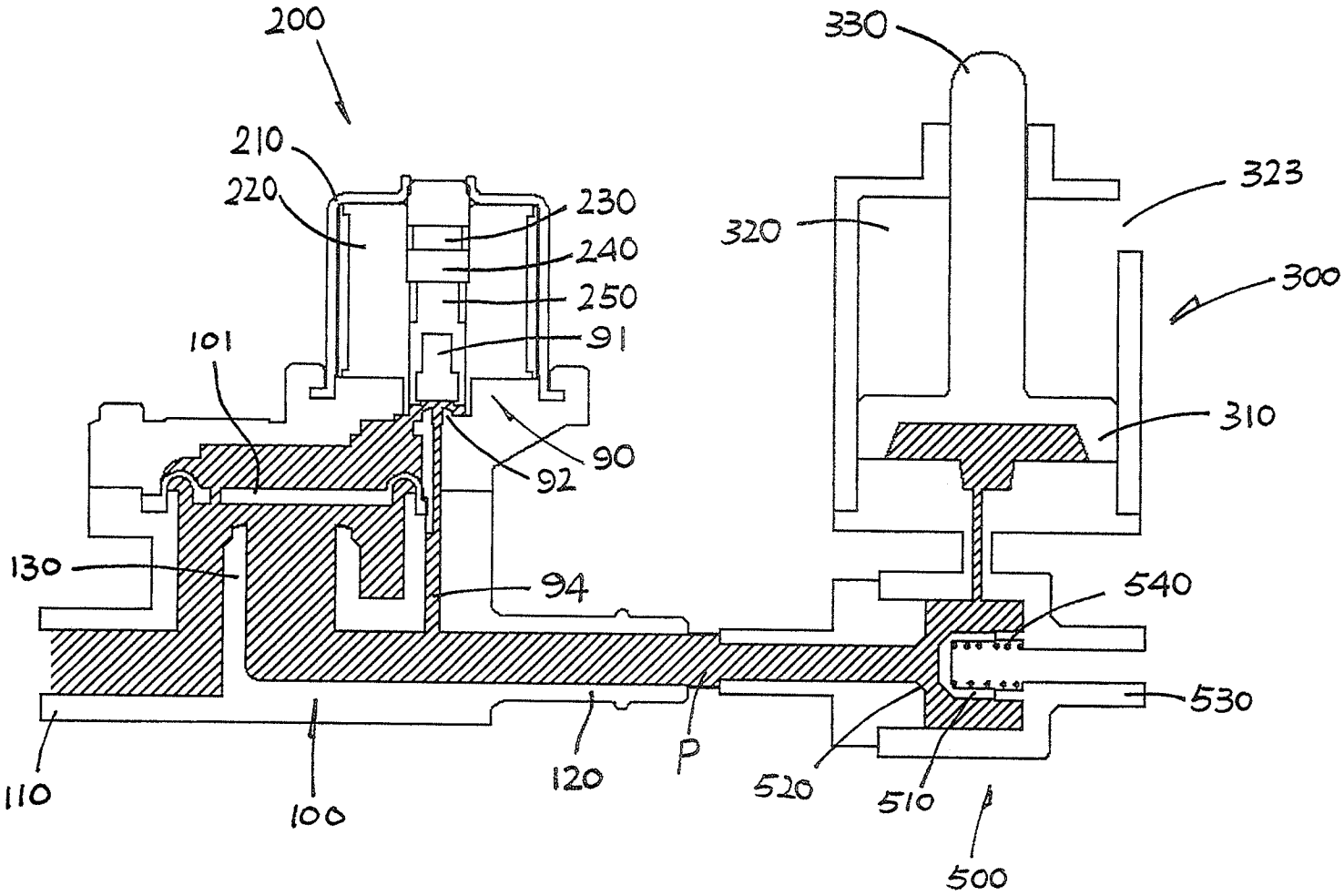
Figure 9:
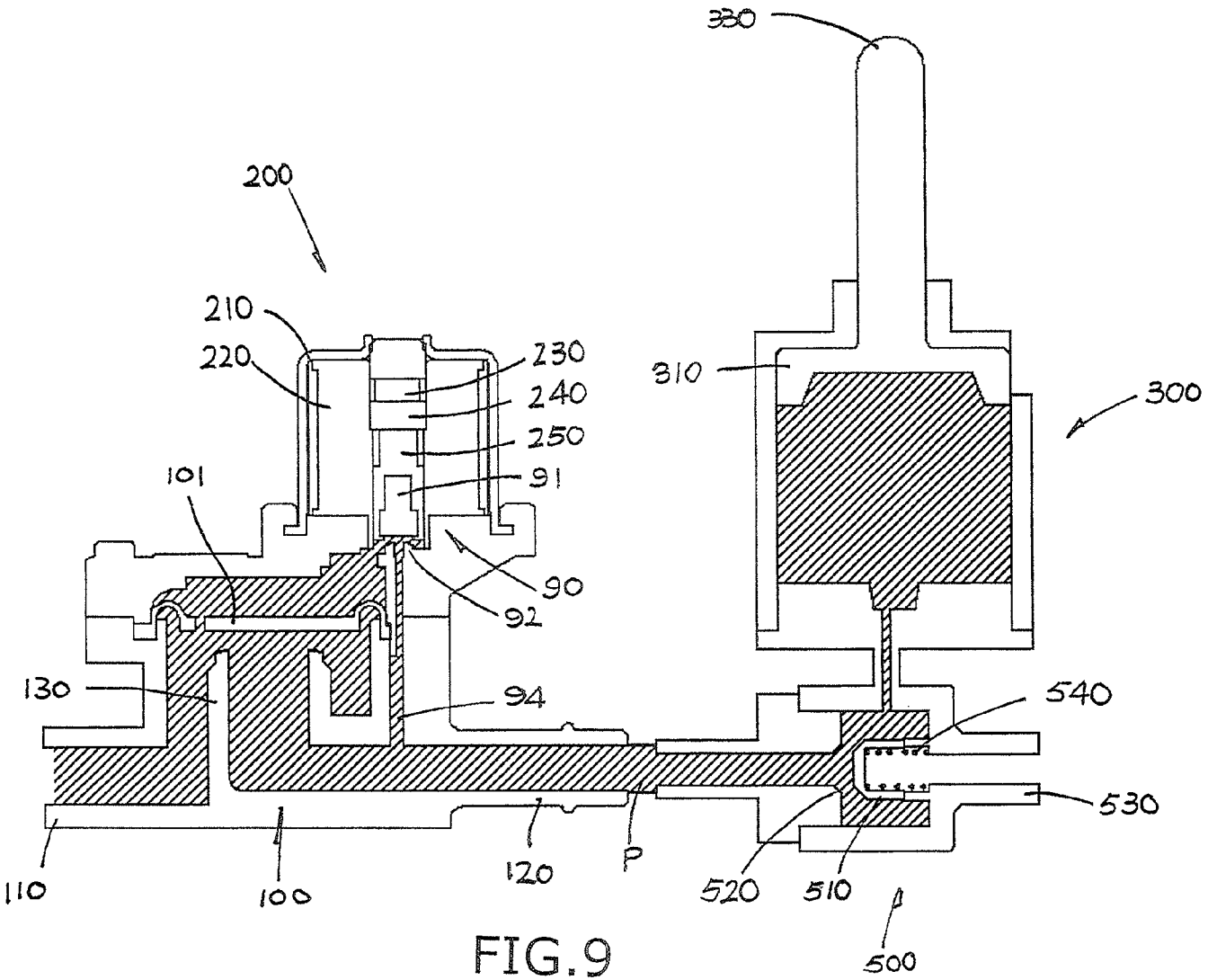
Figure 10:
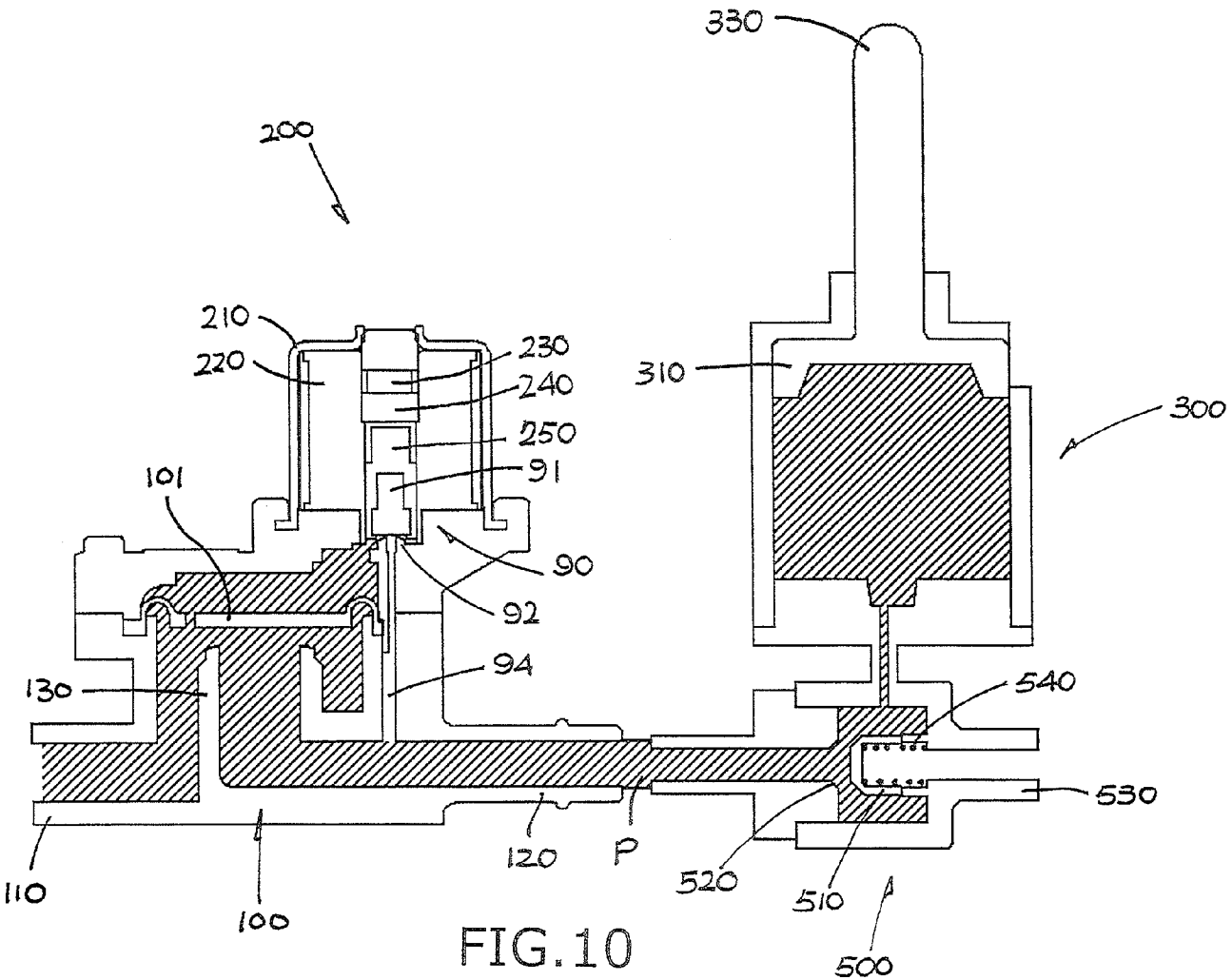

On its way from the outlet 120 of the main valve 100 to the housing 320 of the hydraulic cylinder 300, water running from the main valve's core 130 presses upon the valve member 510 head-on and thus opens the shuttle valve 500 (counteracting the spring 540) for flowing into the housing 320, thereby advancing the piston 310 and extending the rod 330 (FIGS. 8 to 9). The shuttle valve 500 will remain open to permit this flow for as long as water is running past it in this direction into the hydraulic cylinder 300.

At the end of the aforesaid predetermined period of time of operation, the latching solenoid 200 is energized to close the pilot valve 90 (FIG. 10) and in turn also the main valve 100 (FIG. 11), thereby stopping the flow of water from the water source 1 into the subject actuator assembly 10. Water pressure drops instantly, and this at once leads to two consequences: cessation of the pushing action of the rod 330 and self re-opening of the shuttle valve 500 (by its own spring 540) for the drain hole 530 (FIGS. 11 and 12).

Figure 11:
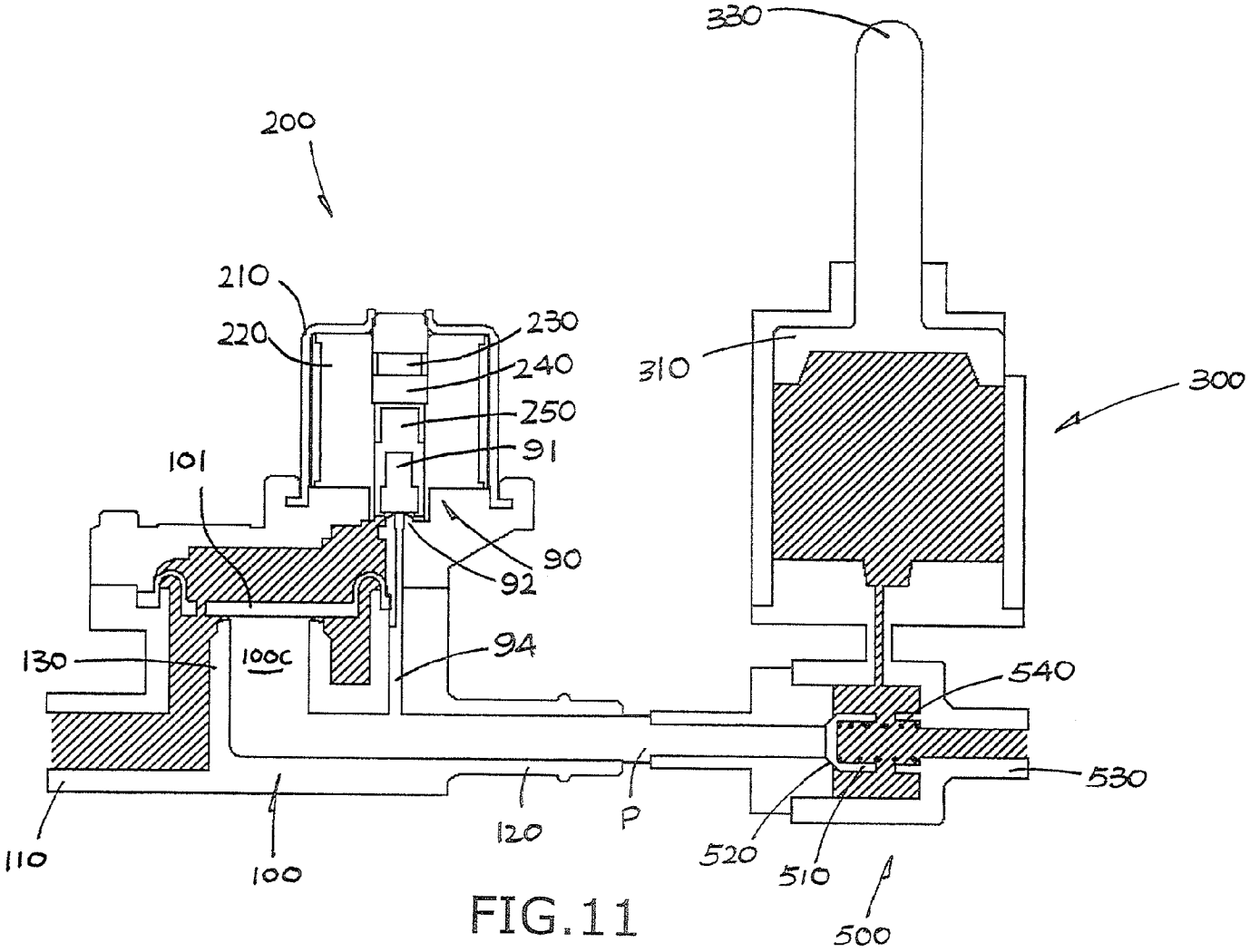
Figure 12:
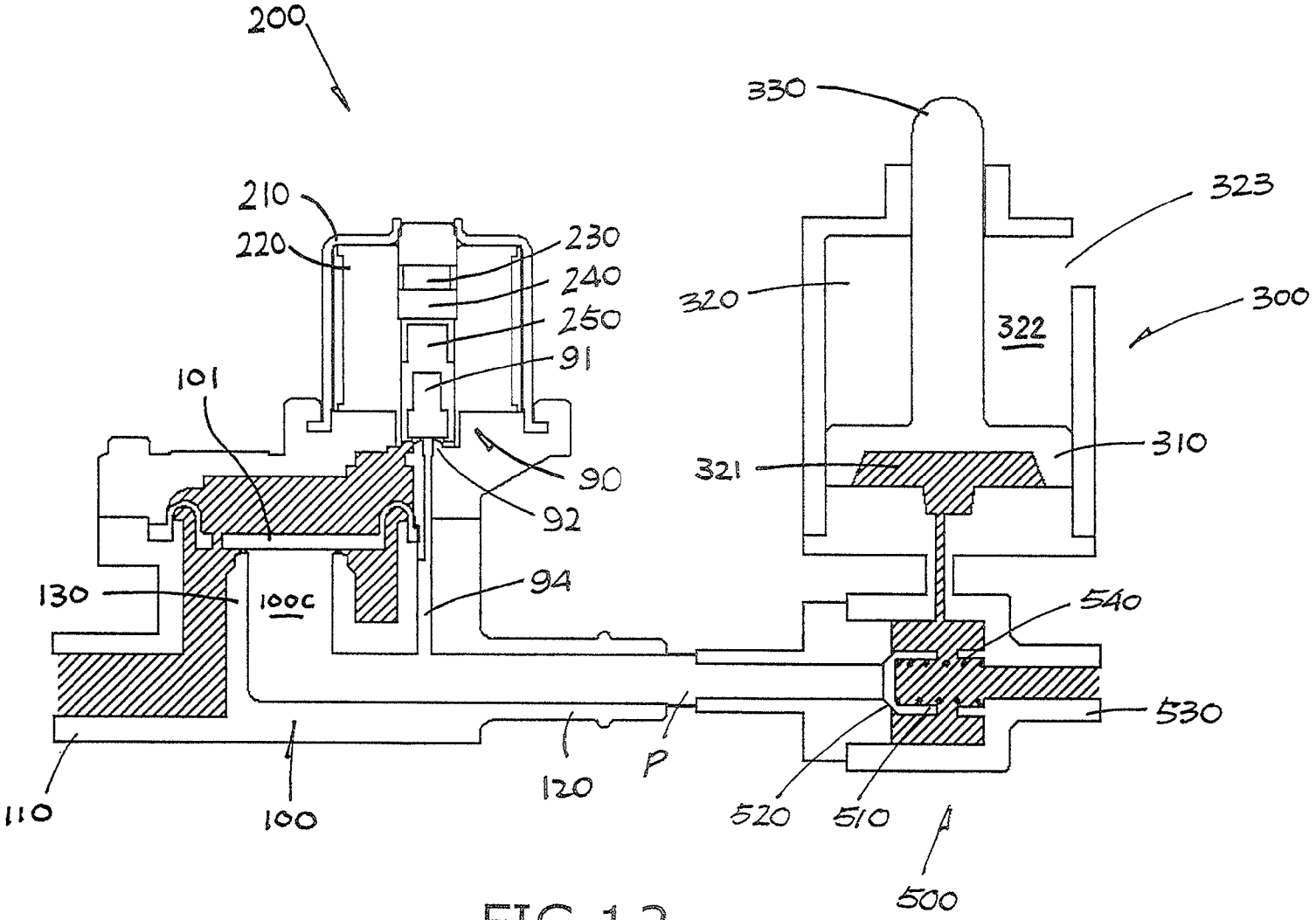
Figure 13:
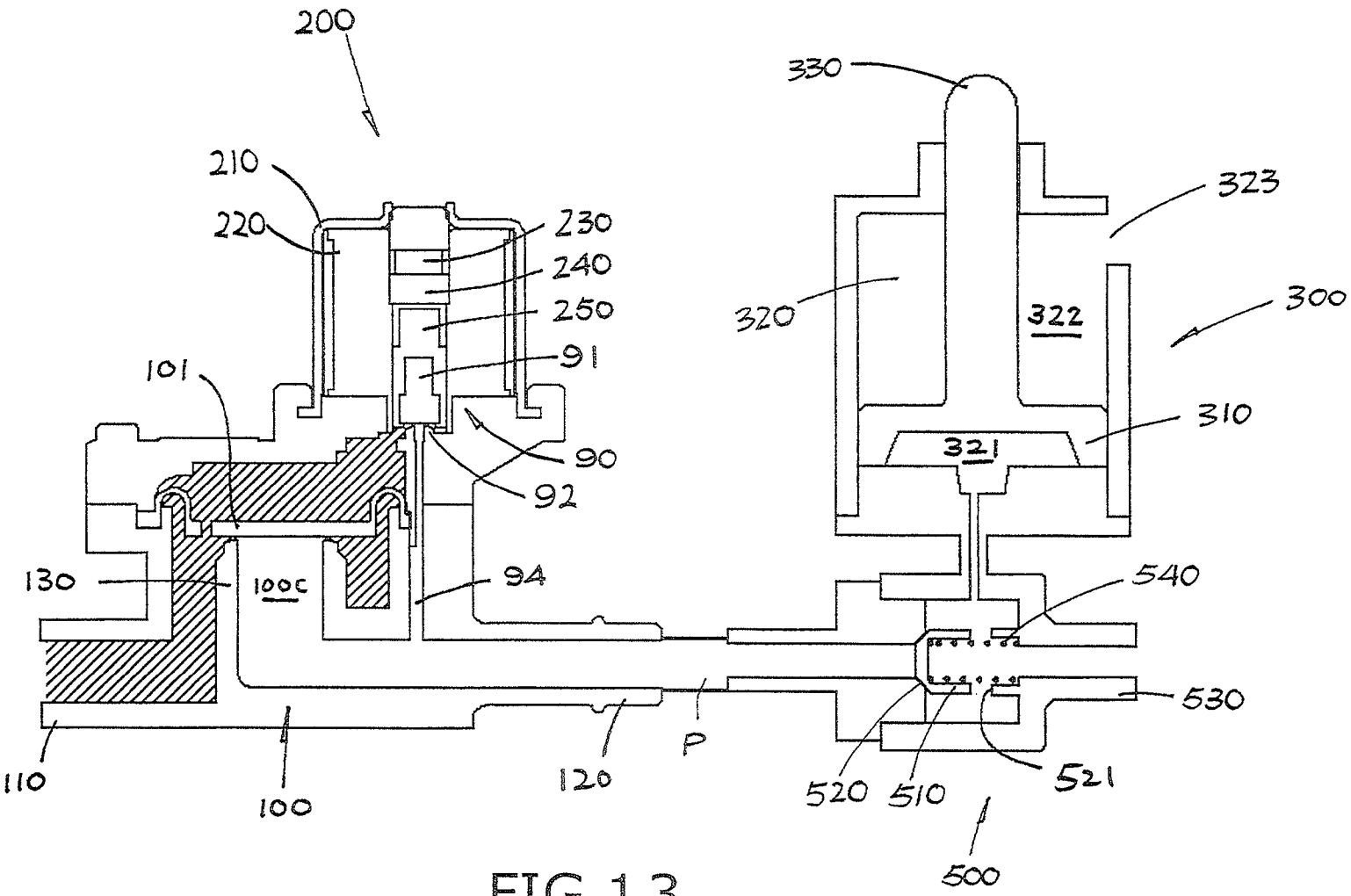
Figure 14:
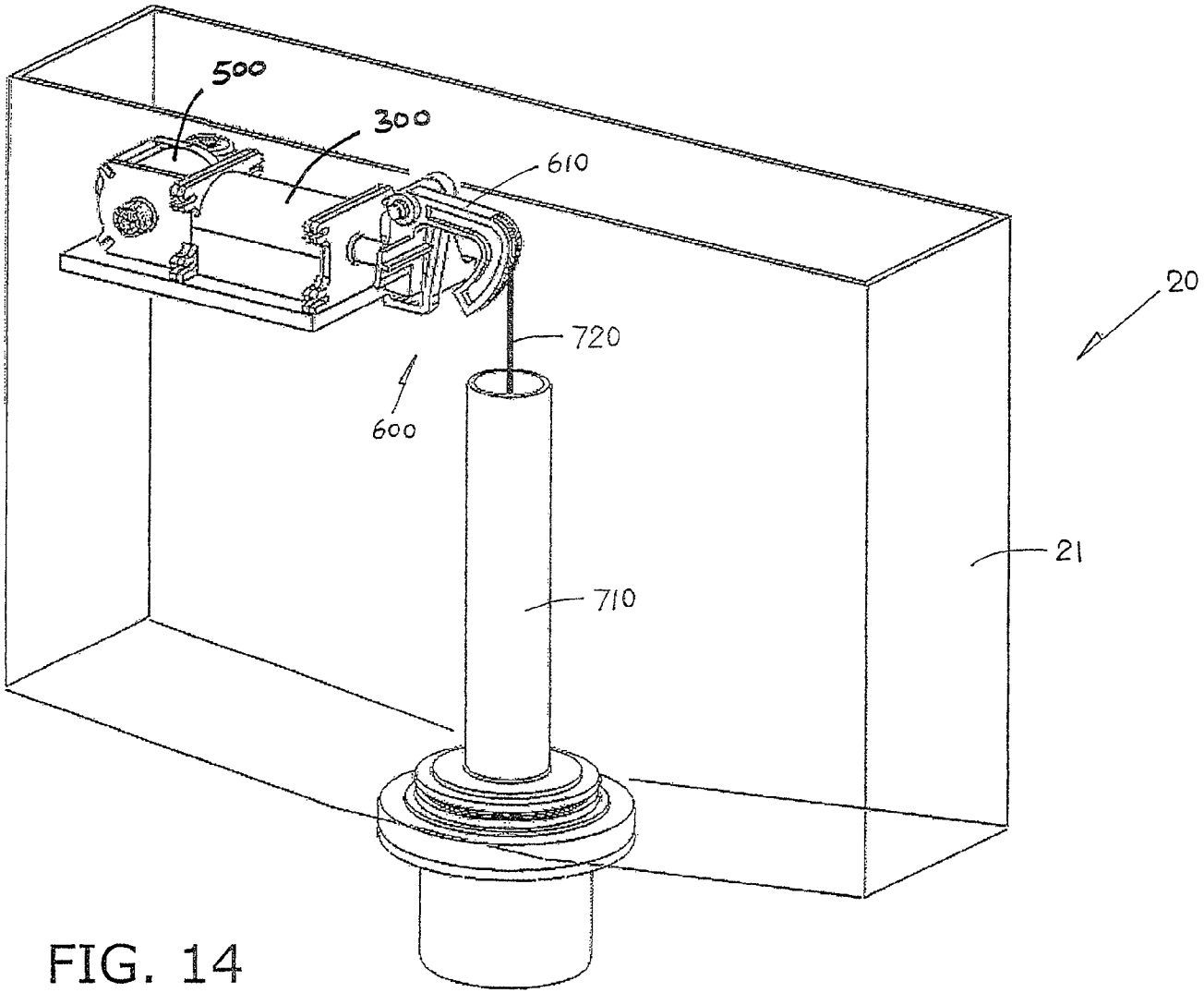
FIG. 14 is a front perspective view of the toilet cistern and fluid-operated actuator assembly of FIG. 1, showing the actuator assembly in an inoperative condition.
Figure 14A:
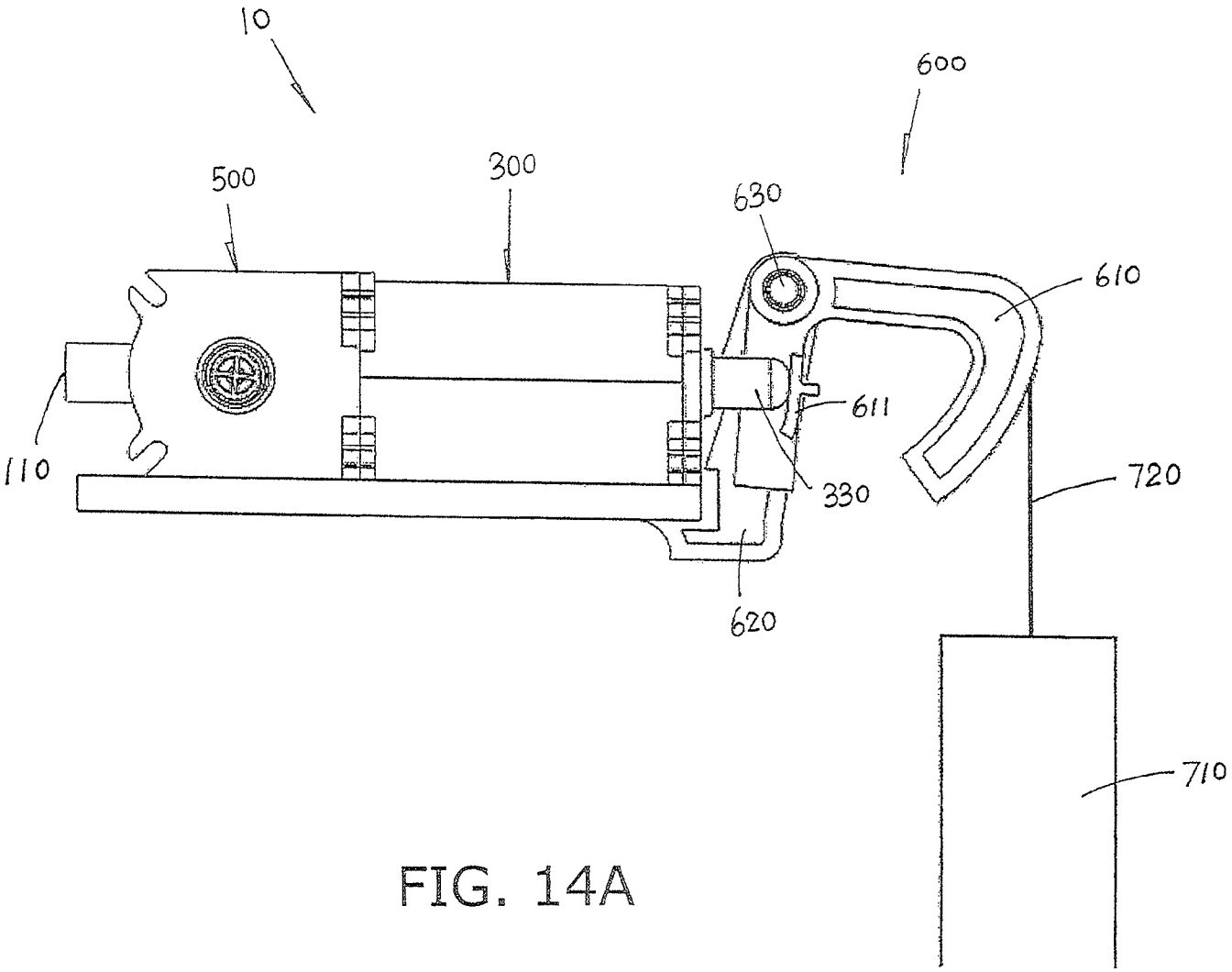
FIG. 14A is a front view of the fluid-operated actuator assembly of FIG. 14.

The rod 330 immediately returns to its inoperative position under the action of a force (e.g. an external force as hereinafter described), causing the piston 310 to press the water in the rear chamber 321 of the actuator's housing 320 out and back to the shuttle valve 500 (FIGS. 11 to 12). With the shuttle valve 500 now opens for the drain hole 530, the water escapes and drains out of the fluid-operated actuator assembly 10. The actuator assembly 10 then will return or is reset to its original condition (FIG. 13) ready for the next operation.

In this particular embodiment, the actuator assembly 10 further includes a motion converter in the form of a hinge mechanism 600 for changing the direction of action of the actuating member i.e. the piston 310 or rod 330. The hinge mechanism 600 is formed by a C-shaped bracket 610 connected to a base 620 by means of a hinge 630 for pivotal movement relative thereto. The base 620 is mounted on the aforesaid one-piece housing immediately in front of and about the rod 330, such that the rod 330 is aligned to engage, and push, the bracket 610 by a small pedal 611 of the bracket 610.

Figure 15:
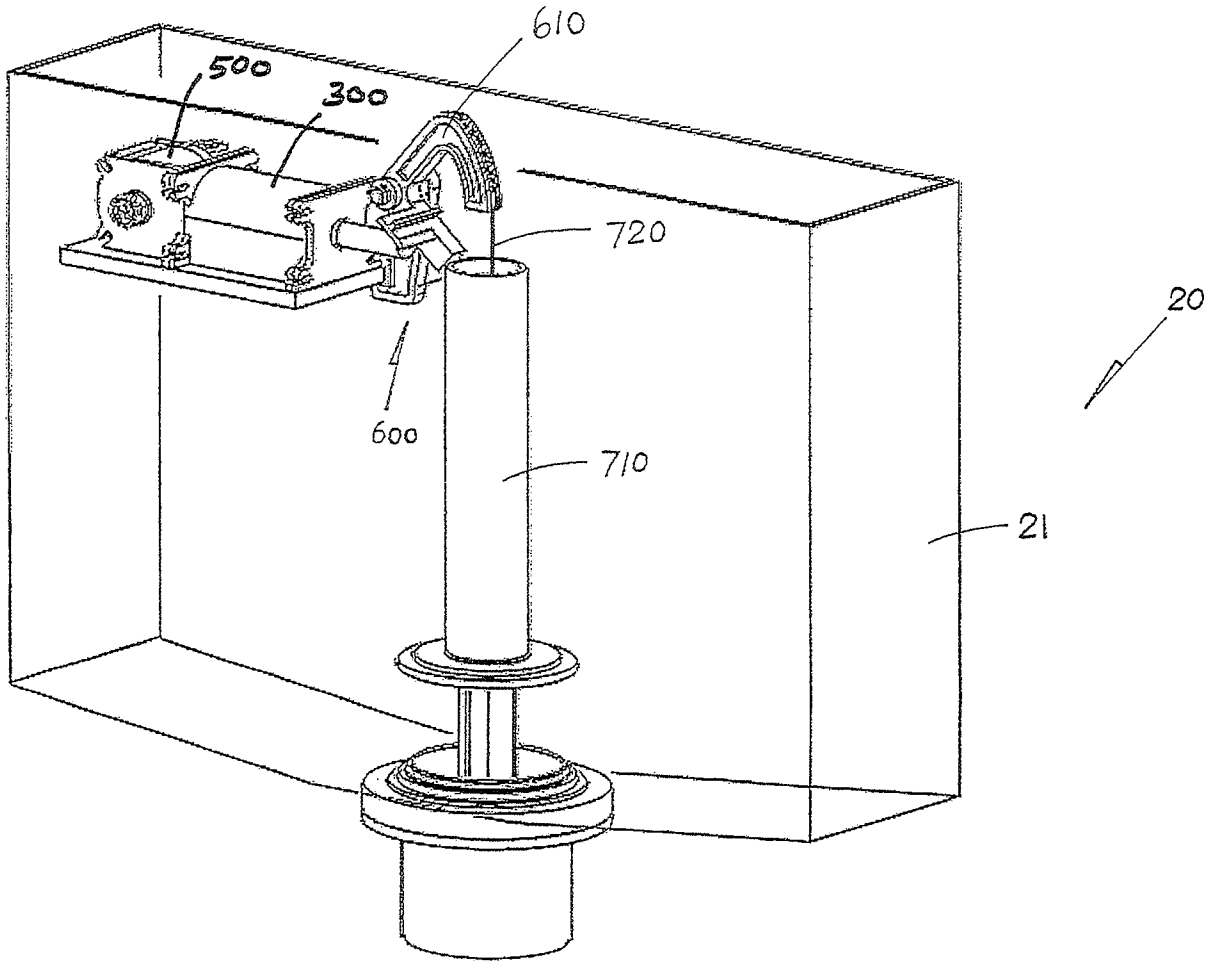
FIG. 15 is a front perspective view equivalent to FIG. 14, showing the actuator assembly in an operative condition.
Figure 15A:
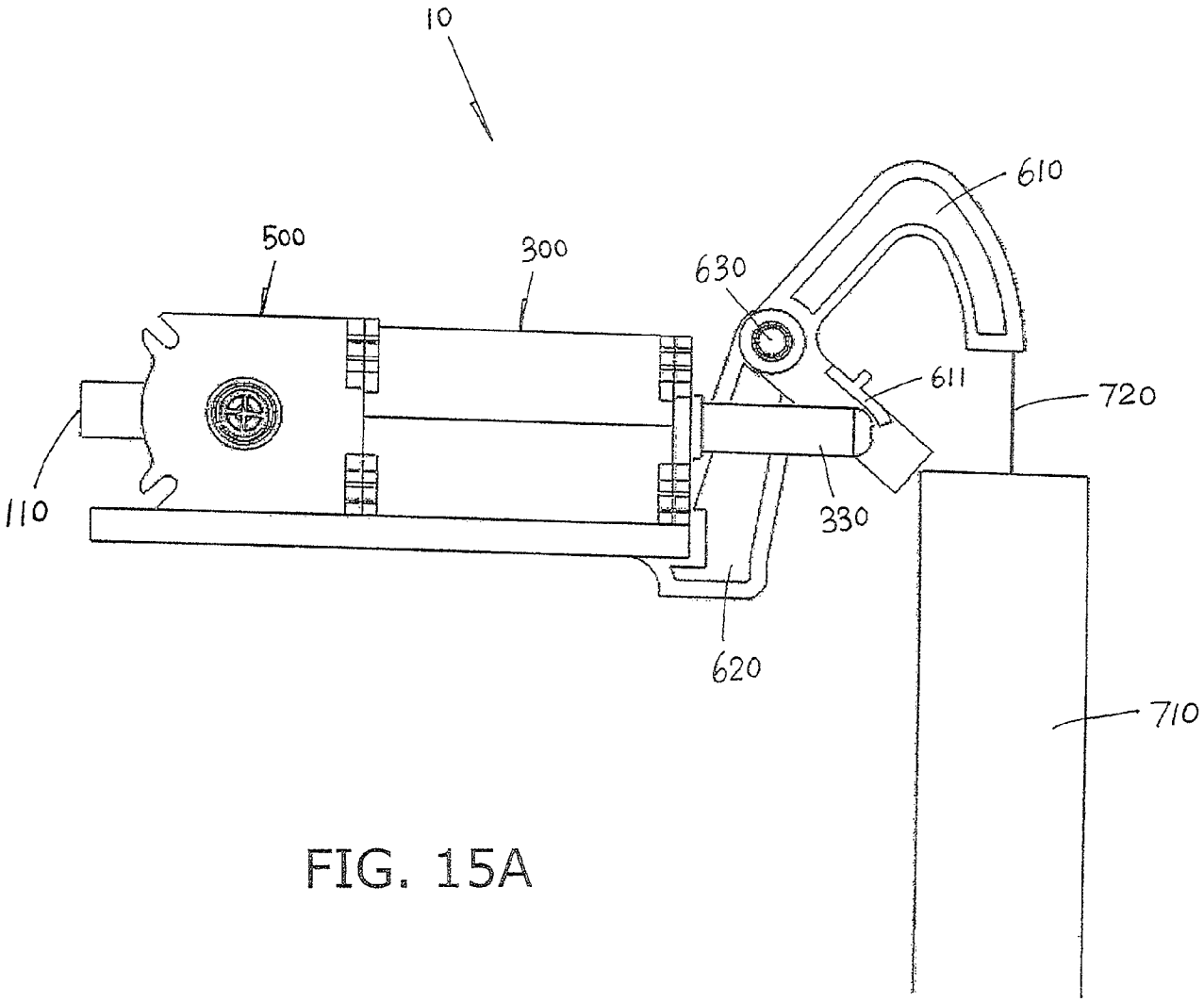
FIG. 15A is a front view of the fluid-operated actuator assembly of FIG. 15.

As the rod 330 is extended from the inoperative position to the operative position, it pivots the hinged bracket 610 upwardly anti-clockwise to an upper operative position (FIG. 15). Later, the bracket 610 may pivot or be pivoted downwardly clockwise back to a lower inoperative position, thereby pushing and returning the rod 330 back to the inoperative position. The hinged bracket 610 acts as a modified actuating member of the hydraulic cylinder 300, which operates in a different manner and/or direction compared to the rod 330.

The fluid-operated actuator assembly 10 is designed for installation and use, among its intended applications, with a flush toilet that has a toilet bowl 30, to which a toilet cistern 20 is close coupled and on which a two-piece hinged seat 40 and toilet bowl lid 50 is typically mounted on the back of the toilet bowl 30 to allow covering the toilet or sitting (or not) while using the toilet. The toilet cistern 20 has a body or tank 21 acting as a reservoir to hold water for toilet flushing, and includes a flushing mechanism 700 which includes a flushing valve 710 located at the bottom of the tank 21 for flushing water out of the tank 21.

The fluid-operated actuator assembly 10 may be employed to trigger flushing of the toilet in a first embodiment, or to open and close the lid 50 in a second embodiment.

In the first embodiment, the fluid-operated actuator assembly 10 is mounted within the top of the tank 21, with the hydraulic cylinder 300 and the shuttle valve 500 inside the tank 21 and the main valve 100 and in particular the latching solenoid 200 outside the tank 21 for waterproof or at least to avoid excessive exposure to moisture. A string or chain 720 connects or couples an uppermost end of the flushing valve 710 to a tip of the hinged bracket 610 of the hinge mechanism 600 of the actuator assembly 10.

The flushing valve 710 is operable upon being lifted by a driving force from the hinged bracket 610 (acting as a modified actuating member) as the bracket 610 is pivoted from the lower to the upper position corresponding to the inoperative and operative positions of the rod 330. The valve 710 operates by being opened wide to let water to rush down from the tank 21 into the toilet bowl 30, thereby performing a flushing cycle which should take about 6 to 9 seconds to complete.

The hinge mechanism 600 includes a hinge for converting the horizontal motion of the rod 330 into vertical or upward motion for lifting the flushing valve 710. The hinged bracket 610 is arranged to support the weight of the flushing valve 710 (in the water) when it is being pivoted from the lower inoperative position to the upper operative position, while lifting and hence opening the flushing valve 710.

Upon completion of the flushing cycle, by virtue of gravitational force, the bracket 610 is later returned to the lower position under the action of the weight of the flushing valve 710. This returns or resets the actuator assembly 10 to its original condition ready for the next flushing operation.

To cater for an insufficient weight of the flushing valve 710 to reset the actuator assembly 10 to its original condition (i.e. pushing the actuating rod 330 back) or to avoid excessive hindering upon descend of the flushing valve 710, a spring may be installed inside the hydraulic cylinder 300 to bias the piston 310 rearward.

During operation of the actuator assembly 10, water that leaks out through the exposed hole 323X of the hydraulic cylinder 300 and water that drains out from the shuttle valve 500 is collected in the same reservoir below provided by the tank 21 of the toilet cistern 20.

Figure 2:
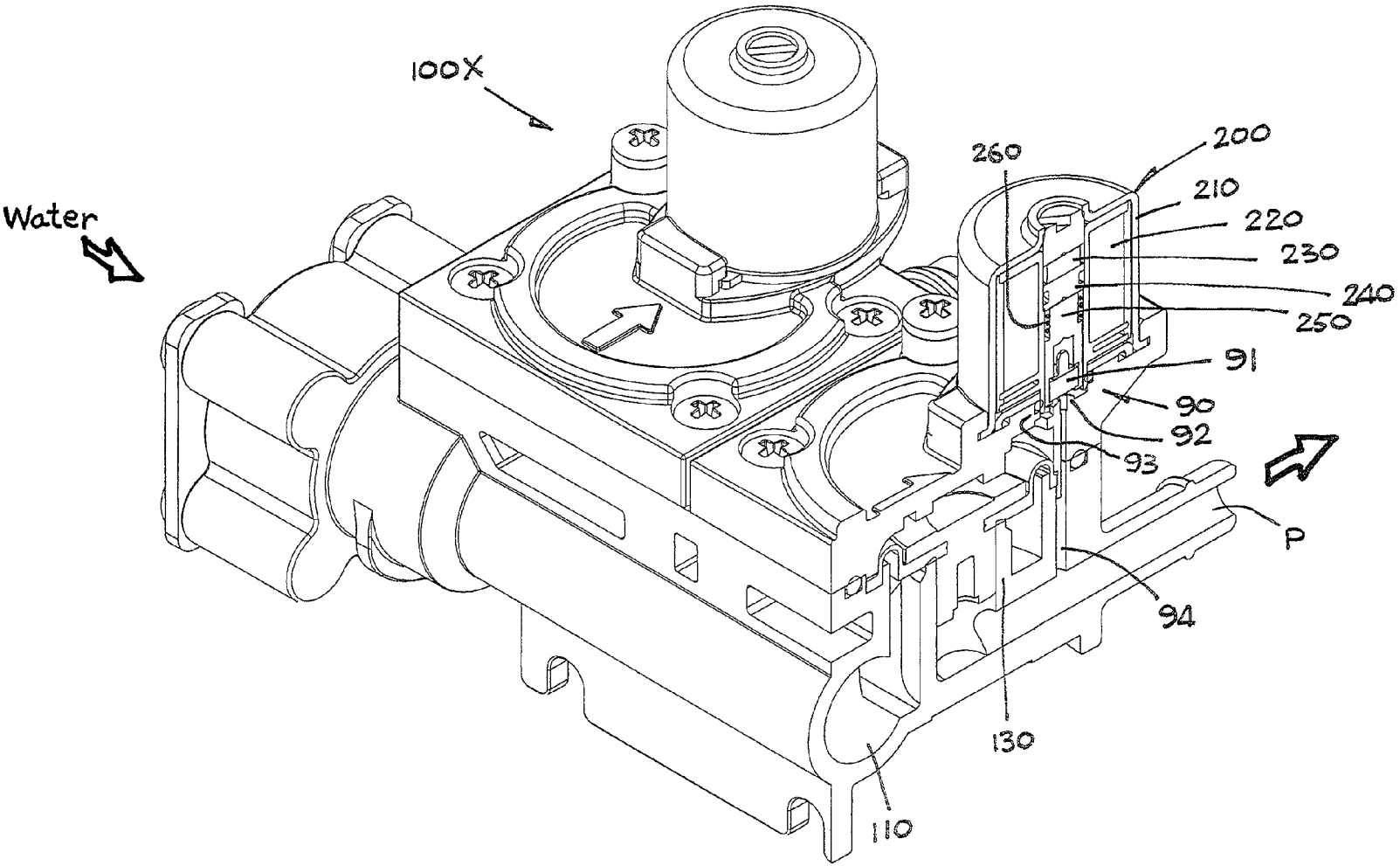
FIG. 2 is a partially cutaway perspective view some parts of the fluid-operated actuator assembly of FIG. 1.
Figure 2A:
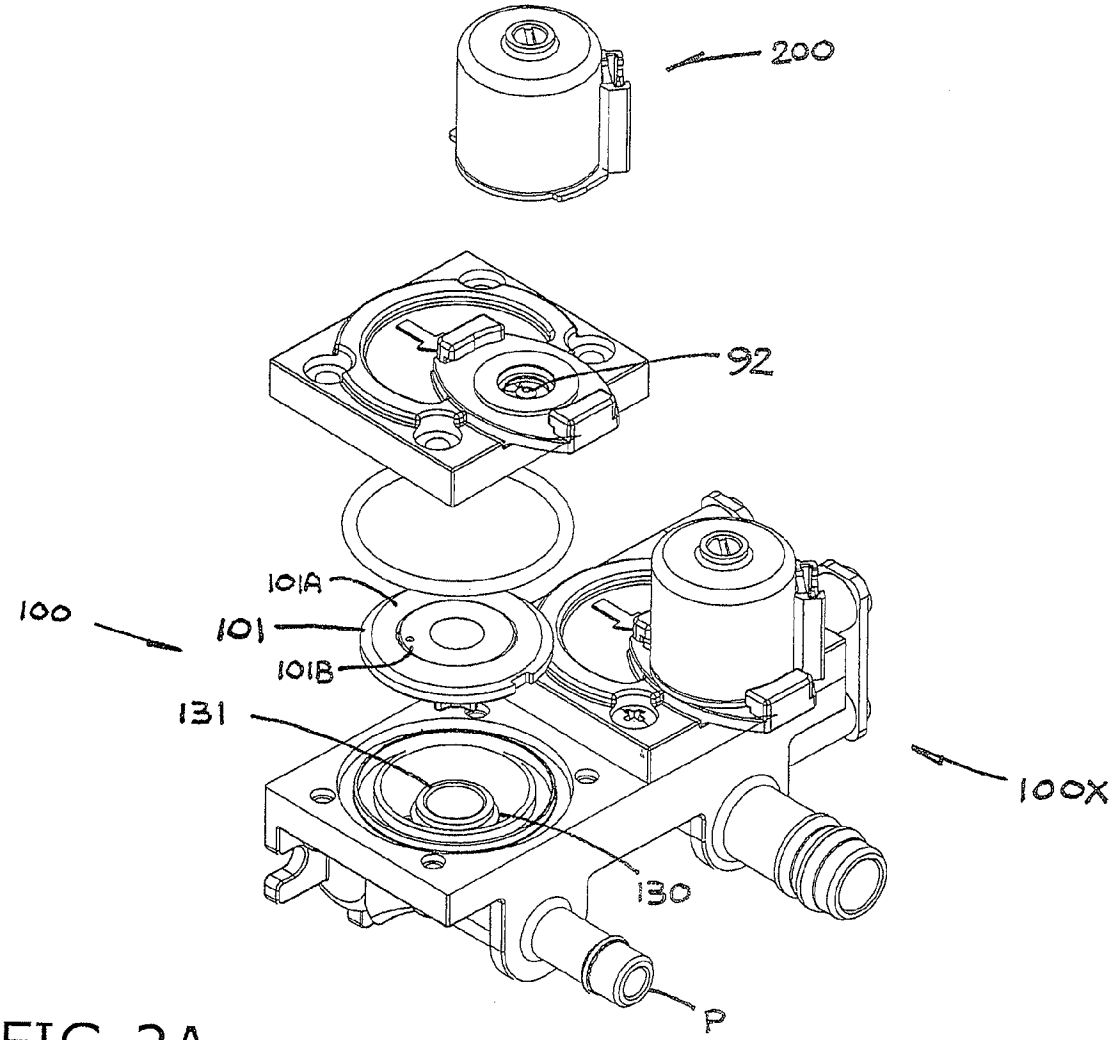
FIG. 2A is a partially exploded perspective view of the parts of the fluid-operated actuator assembly of FIG. 2.
Figure 3:
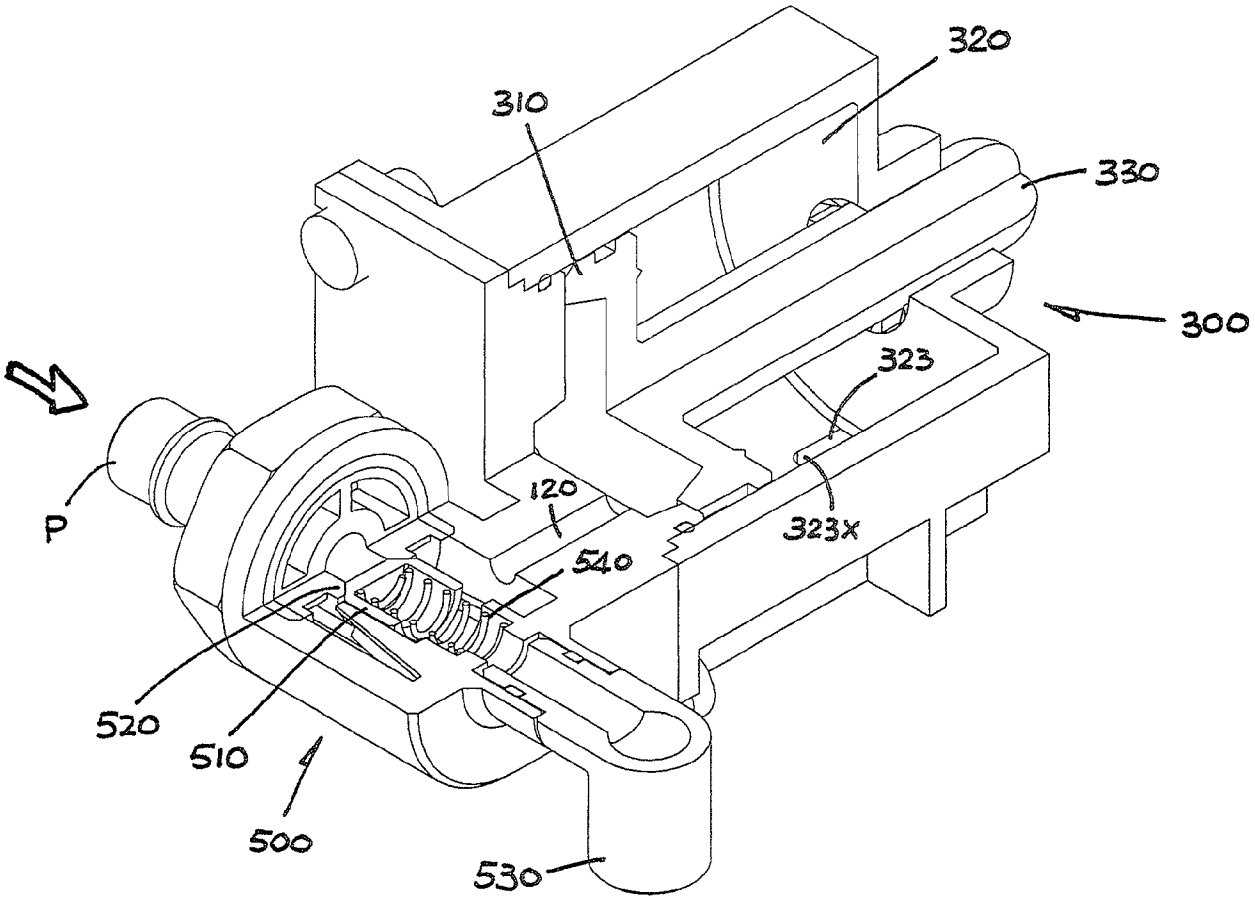
FIG. 3 is a cutaway perspective view of other parts of the fluid-operated actuator assembly of FIG. 1.
Figure 4:
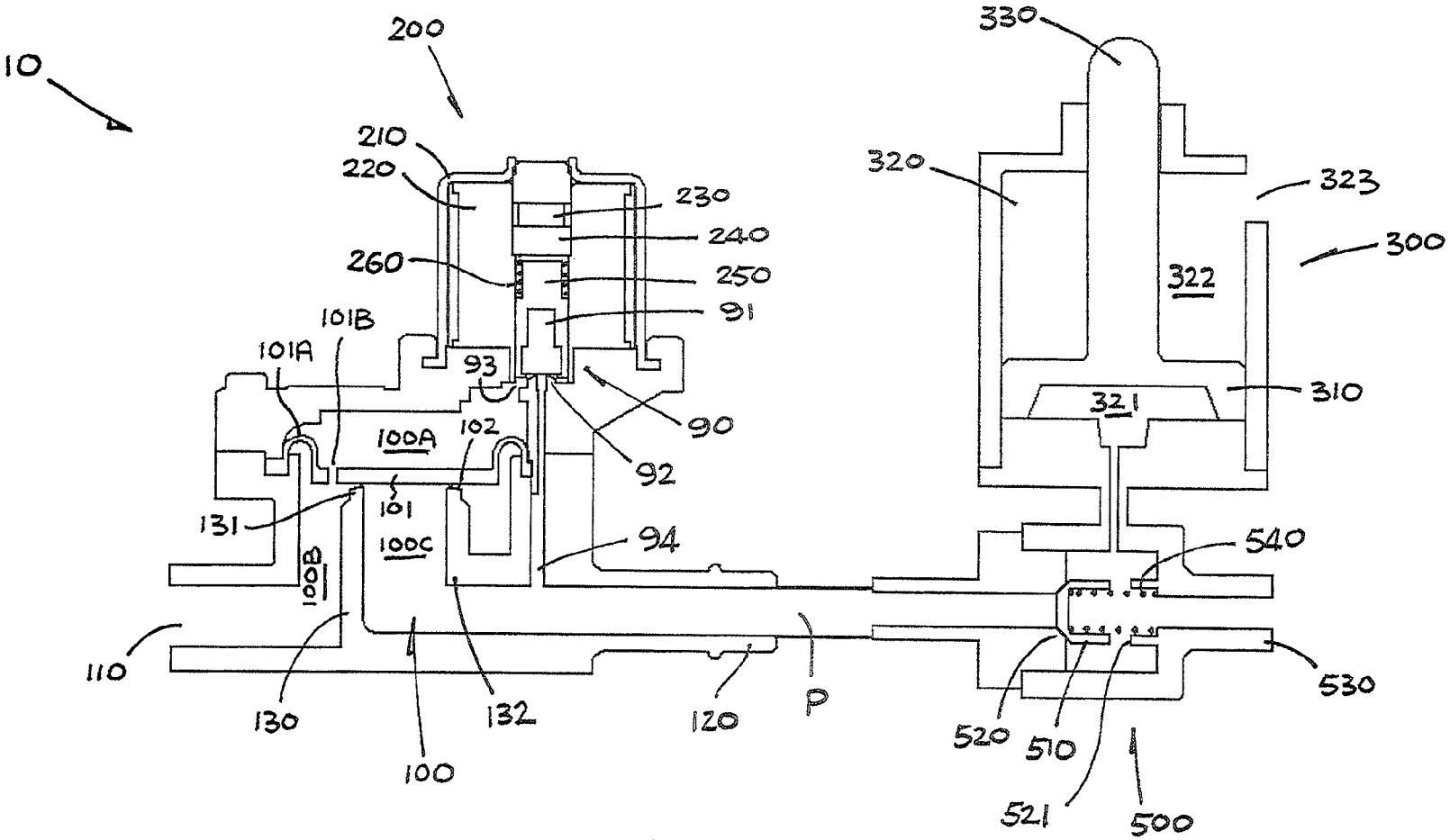
FIG. 4 is a schematic cross-sectional view of the fluid-operated actuator assembly of FIGS. 2 and 3.

Optionally, an extra set 100X of the main valve 100, latching solenoid 200 and control circuit 400 (FIGS. 2 and 2A) may be used for controlling refill of the toilet cistern 20 with water after each flushing operation.

Reference is now also made to FIGS. 16 to 24 of the drawings. In the second embodiment, the fluid-operated actuator assembly 10 is installed to drive a mechanism which includes a gear system in the form of a gear train 70, which in turn opens and closes the lid 50.

The toilet bowl 30 has on its back a bidet module 31, to which the seat 40 is hinged and the lid 50 is pivotably connected by means of one or more connecting members in the form of a pair of pivotal arms 32 on opposite left and right sides of the toilet, its lid 50 and the bidet module 31. The seat 40 and lid 50 are independently pivotable up and down, freely for the seat 40 which thus requires manual operation but automatically for the lid 50 as driven by the actuator assembly 10.

Each pivotal arm 32 is an elongate hollow member, having a rear end 32A connected by means of a rear hinge axle 61 to the relevant side of the bidet module 31 and including a front end 32B connected by means of a front hinge axle to the same side of the lid 50 at about its mid-length. Internally of or inside the right arm 32, unlike the left arm 32, there is installed a gear train 70 for drive transmission.

The gear train 70 is built by $1^{st}$ to $8^{th}$ gears 71 to 78 and a belt in the form of a timing belt 79, all of which are mounted about the two hinge axles 61 and 63 and two extra axles 62 and 64 positioned on opposite sides of the hinge axle 61. The axles 61 to 64 are also referred to as the $1^{st}$ to $4^{th}$ axles, with the axle 64 for rotational drive input and the axles 61 and 63 for rotational drive outputs.

The gears 71 and 77 are a compound gear mounted fast on the axle 64 for rotation by or with the axle 64, with either one of the axle 64 and the gear 77 arranged to receive rotational drive for turning of the axle 64. The gears 73 and 78 are another compound gear which is mounted fast on the axle 61 for simultaneous turning to transmit rotational drive from the latter to the former, with the gear 72 supported between them on the axle 61 for free rotation thereabout.

Figure 16:
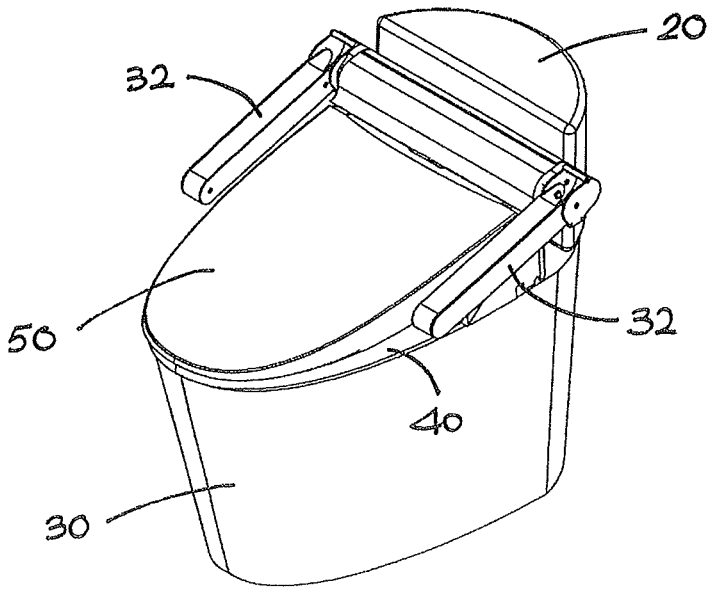
FIGS. 16 and 16A are perspective and side views of the toilet of FIG. 1, including a lid to be opened by a fluid-operated actuator assembly in accordance with the invention, which is installed right behind the lid.
Figure 16A:
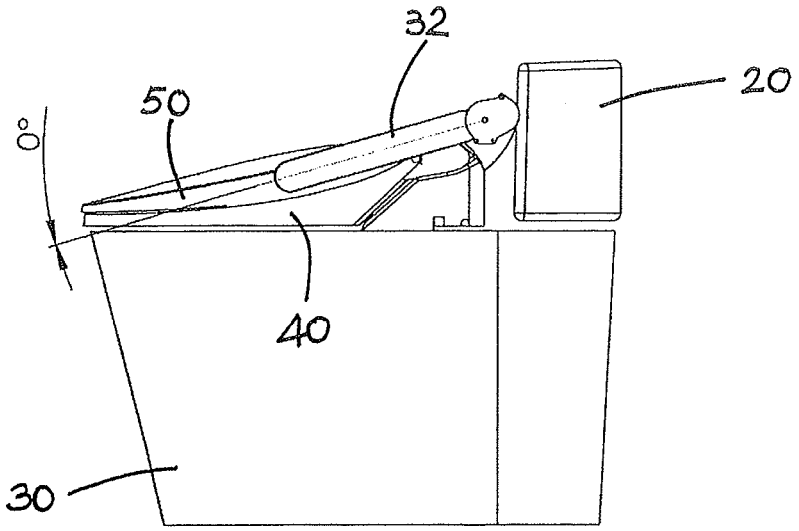
Figure 17:
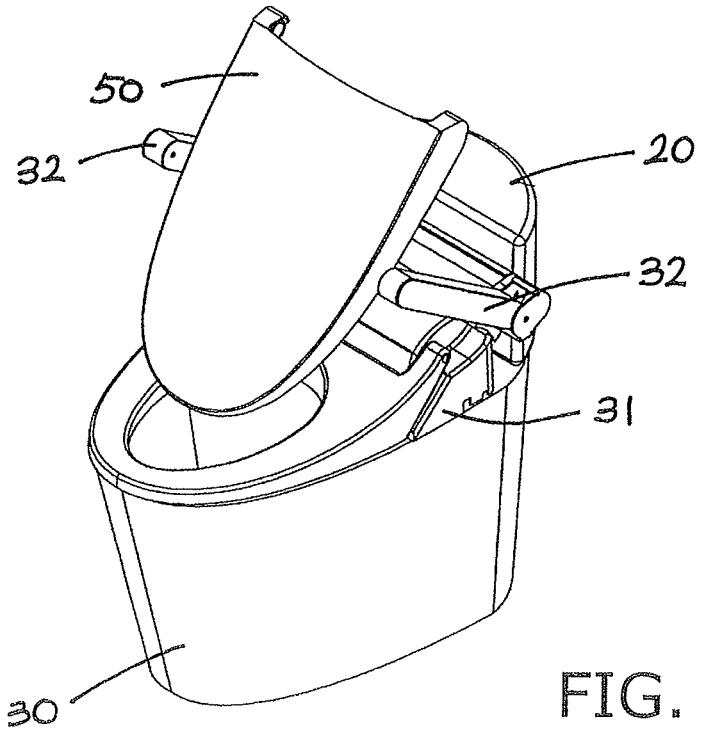
FIGS. 17 and 17A are perspective and side views equivalent to FIGS. 16 and 16A, showing the lid half opened and flipped.
Figure 17A:
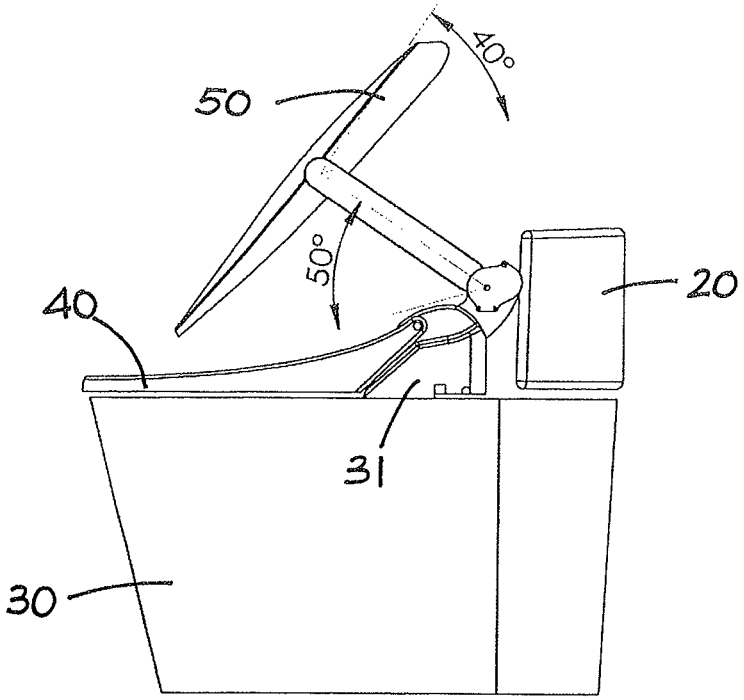
Figure 18:
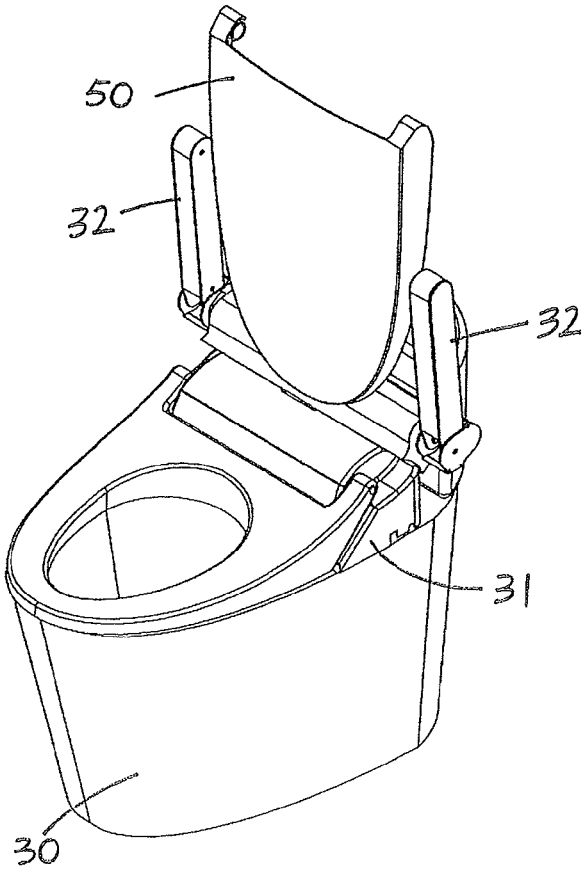
FIGS. 18 and 18A are perspective and side views equivalent to FIGS. 17 and 17A, showing the lid fully opened and flipped.
Figure 18A:
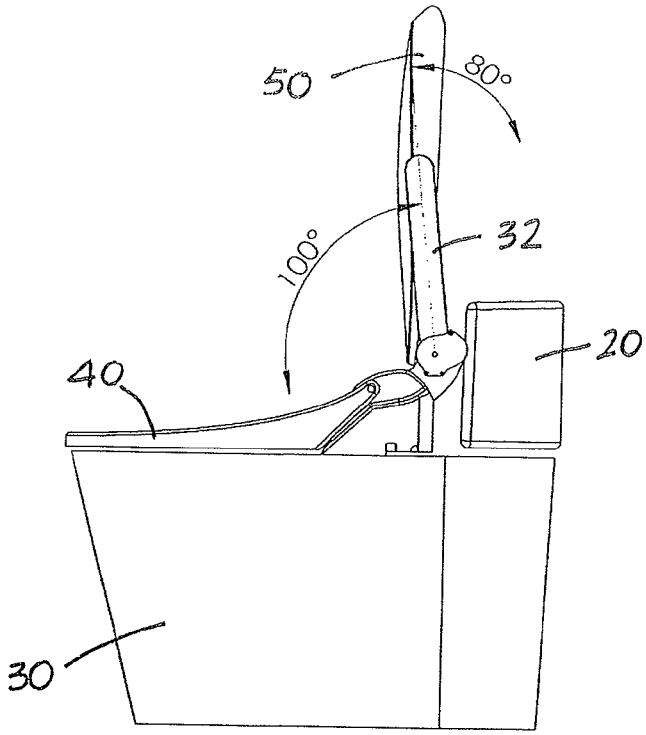
Figure 19:
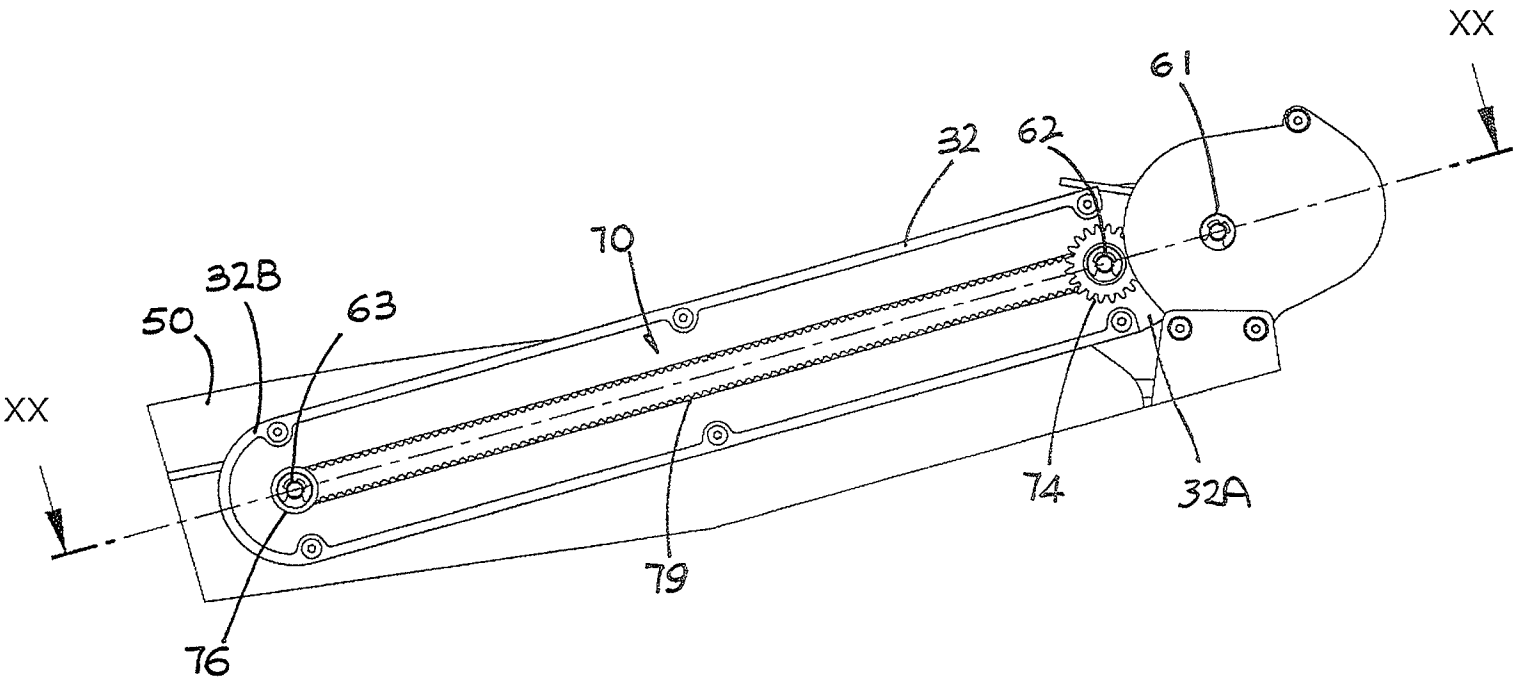
FIG. 19 is a side view of part of the toilet of FIGS. 16 to 18A, showing the right arm of a pair of arms which pivotably connects the lid to the toilet.
Figure 20:
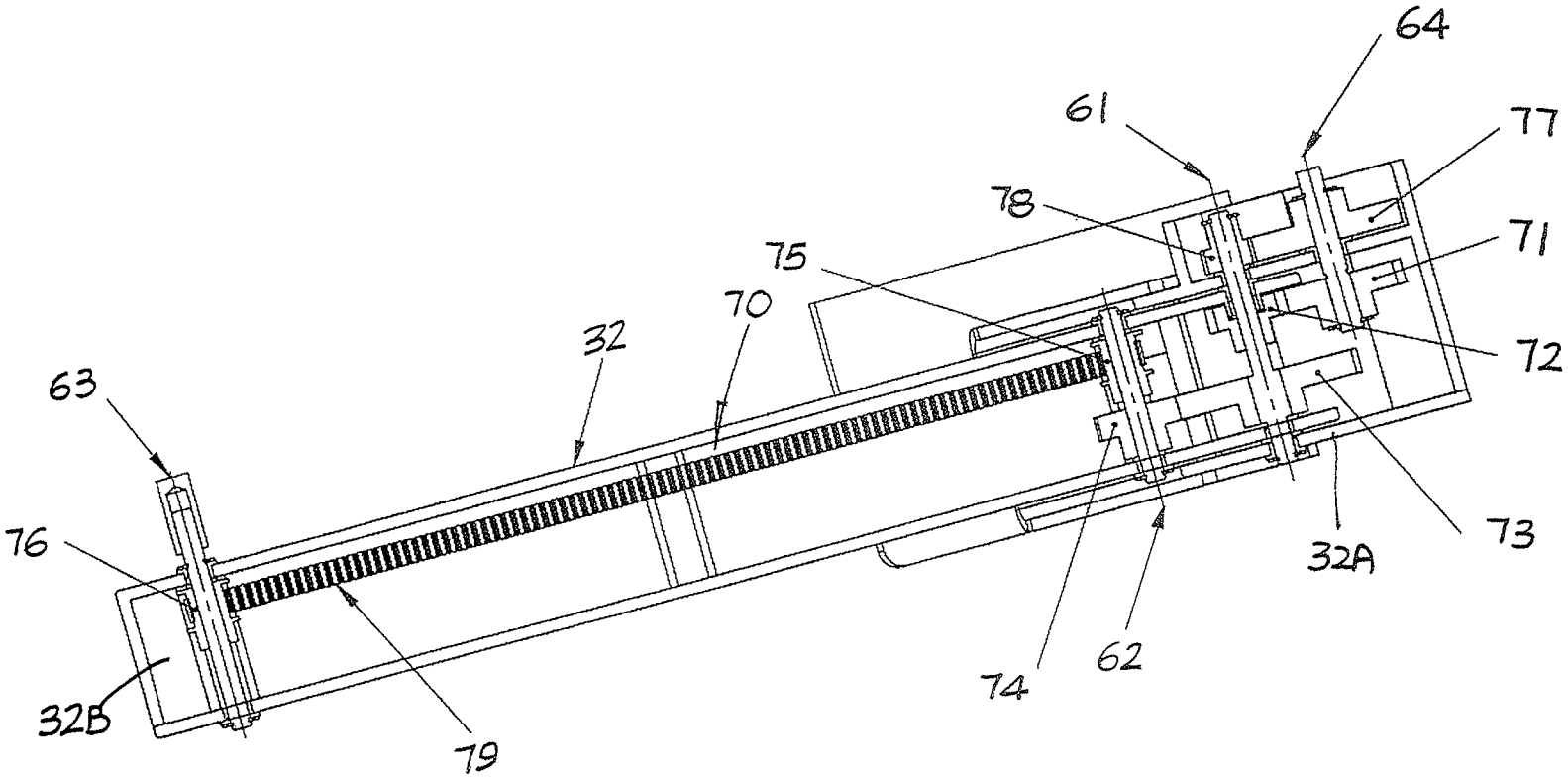
FIG. 20 is a cross-sectional view of the right arm of FIG. 19 taken along line XX-XX, showing a gear train in the arm driven by the fluid-operated actuator assembly to transmit drive to open/close and flip the lid.
Figure 21:
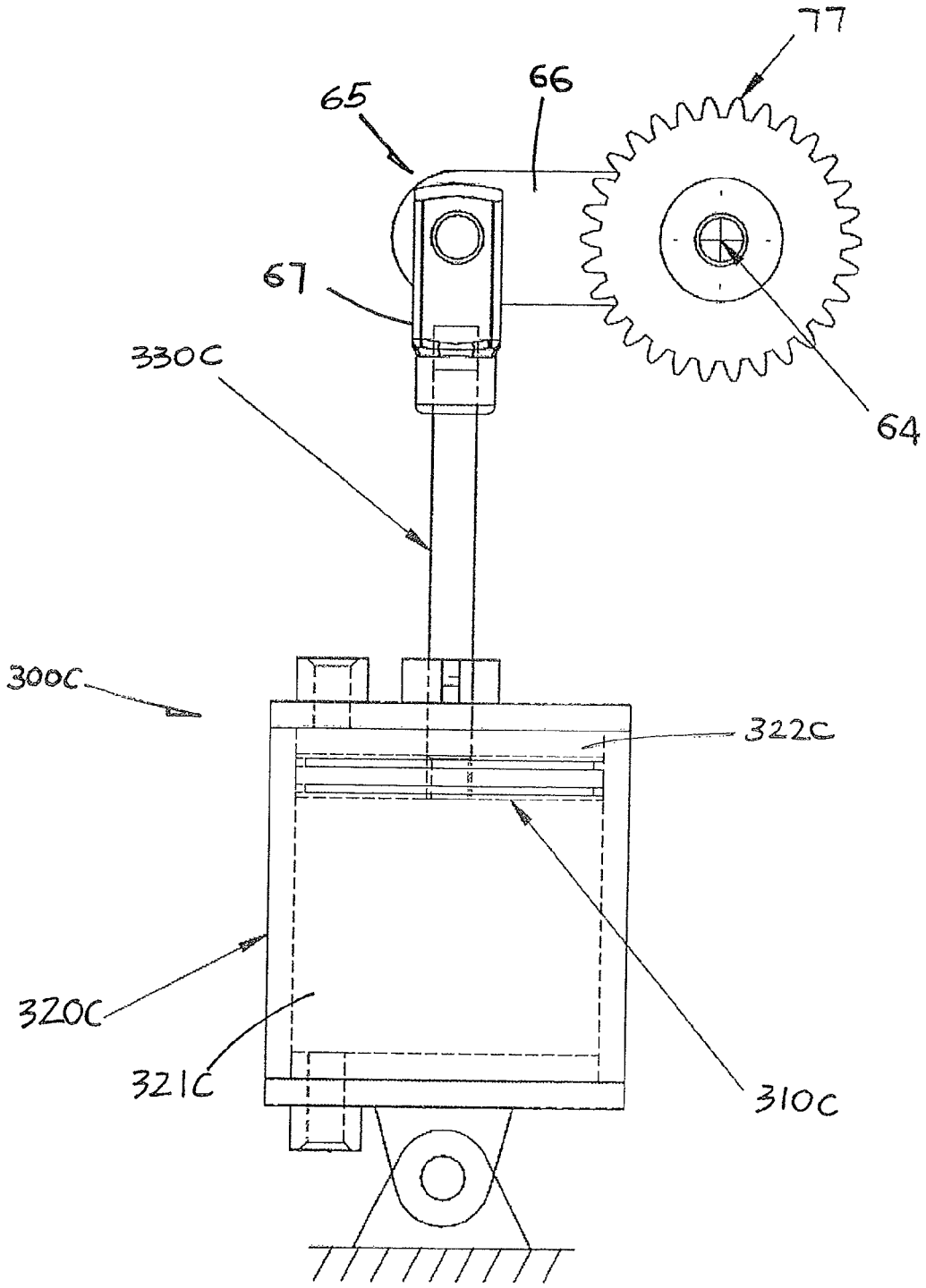
FIG. 21 is a side view of the part of toilet of FIG. 19, showing the right arm being driven by a hydraulic cylinder as one alternative of the fluid-operated actuator assembly.
Figure 22A:
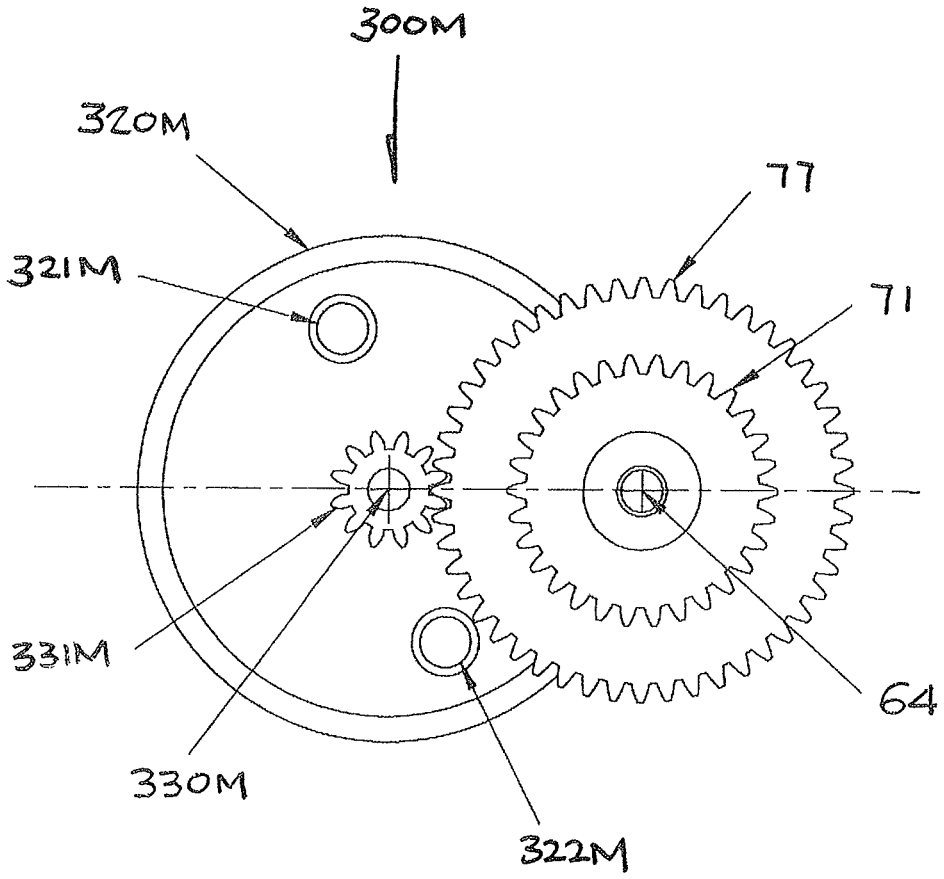
FIG. 22A is a side view of the part of toilet of FIG. 19, showing the right arm being driven by a hydraulic motor as another alternative of the fluid-operated actuator assembly.
Figure 22B:
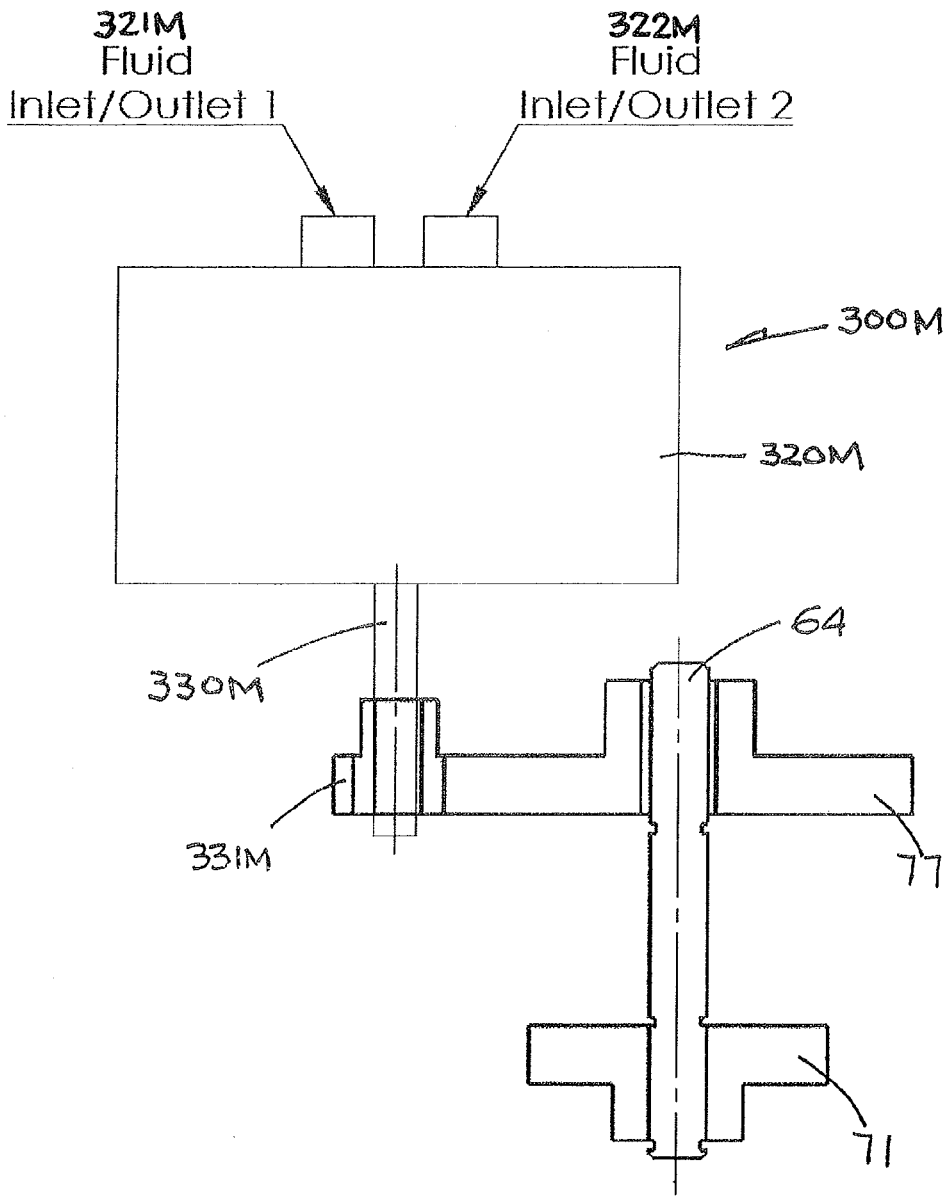
FIG. 22B is a top plan view of the hydraulic motor and some gears of FIG. 22A.

The gear 72 is attached, secured or otherwise fixed to the right arm 32 for pivoting the same as it is being turned by the gear 71 in mesh with it. The gear 71 receives rotational drive from the gear 77 or the axle 64 or via the latter, and in turn rotates the gear 72 to pivot the right arm 32 and hence the lid 50 in opposite directions. In particular, upon anti-clockwise rotation the gear 77 and hence the gear 71 turns the gear 72 clockwise to pivot the right arm 32 up to open the lid 50 (FIGS. 16/16A to 18/18A). Upon subsequent clockwise rotation the gear 77 and hence the gear 71 turns the gear 72 anti-clockwise to pivot the right arm 32 down to close the lid 50 (FIGS. 18/18A to 16/16A).

With the gear 72 being freely rotatable about the axle 61, the gear 78 receives rotational drive from the gear 77 and then passes on the rotational drive through to the gear 73 past the gear 72 while the gear 72, upon being turned by the gear 71, is opening or closing the lid 50.

The gears 74 and 75 are yet another compound gear which is disposed about the axle 62 for simultaneous free rotation, with the gear 74 in mesh with the gear 73 for turning thereby such that the rotational drive reaches the gear 75. The last gear 76 is mounted fast on the axle 63 for rotation thereby. The timing belt 79 is stretched across the gears 75 and 76 for transmitting rotational drive from the gear 75 at the rear end 32A of the right arm 32 along the length of the arm 32 to the gear 76 at the front end 32B. The gear 76, while being driven by the axle 63, is coupled with the lid 50 for outputting the rotational drive to flip the lid 50 as the lid 50 is being opened or closed.

Here comes a rundown on the operation. Being applied to the axle 64 optionally via the gear 77, the rotational drive is split and transmitted along two paths. The first path extends from the gear 77, via the axle 64 and gear 71, to reach the gear 72, which then pivots the right arm 32 up to open the lid 50 (FIGS. 16/16A to 18/18A) or down to close the lid 50 (FIGS. 18/18A to 16/16A). The second path extends from the gear 77 and then the gear 78 through to the gear 73, then past the gear gears 74 to 75 and via the timing belt 79 to reach the gear 76, which then flips the lid 50 back up as the lid 50 is being opened (FIGS. 16/16A to 18/18A) or flips the lid 50 back down as the lid 50 is being closed (FIGS. 18/18A to 16/16A).

The lid 50 is pivoted and flipped simultaneously between a normal closed position and a full open position in which the lid's underside (considered unhygienic) faces to the back off a user.

The fluid-operated actuator assembly 10 is installed inside the bidet module 31, externally of the cistern 20, with appropriate pipelines connected to the water source 1 for supply of water and to the cistern 20 for discharging water thereto.

To drive the gear train 70, the actuator assembly 10 may incorporate either a hydraulic cylinder 300C or a hydraulic motor 300M, which is located adjacent the right arm 32.

Figure 23:
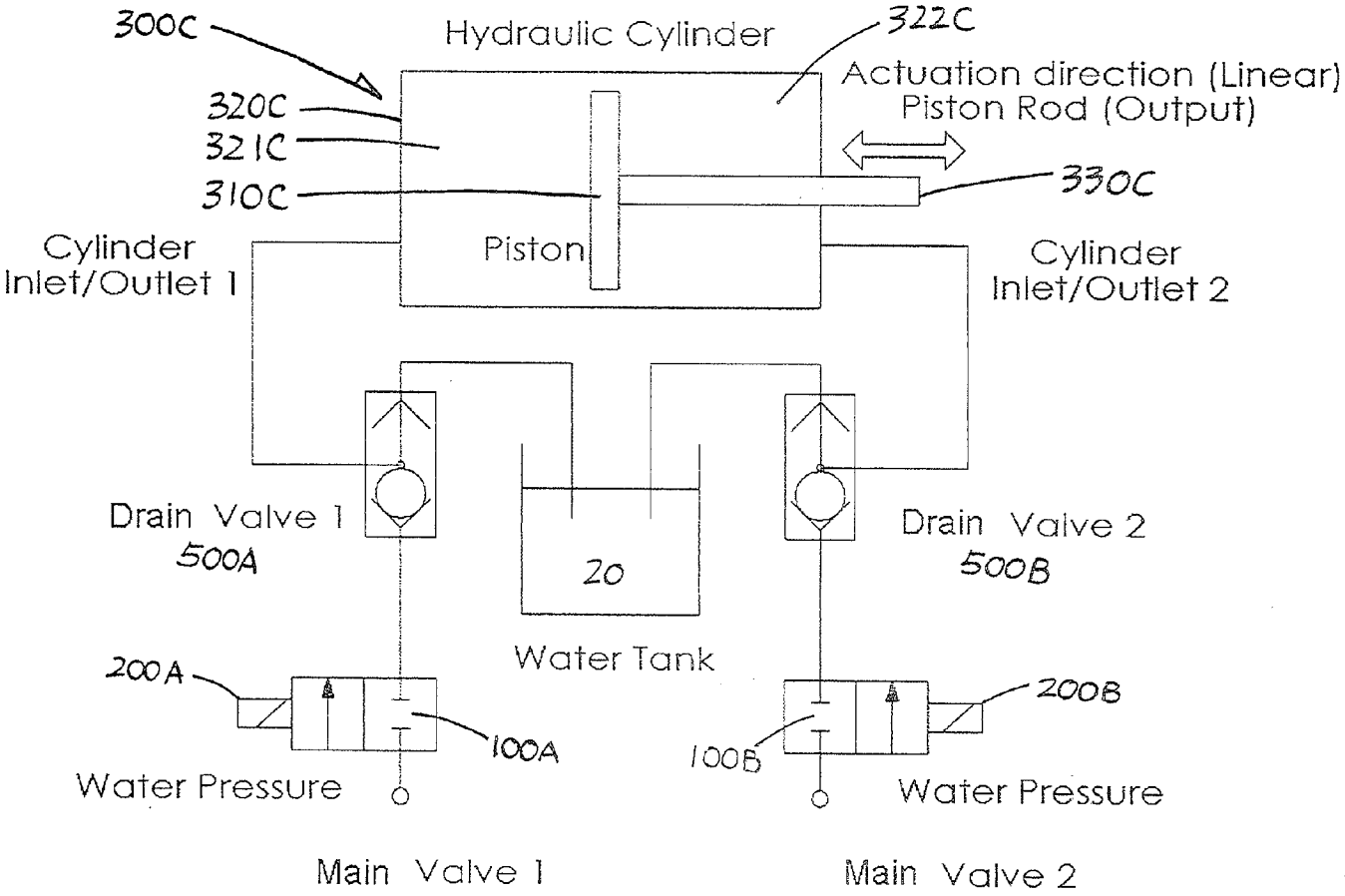
FIG. 23 is a schematic circuit diagram of the fluid-operated actuator assembly including the hydraulic cylinder of FIG. 21.
Figure 24:
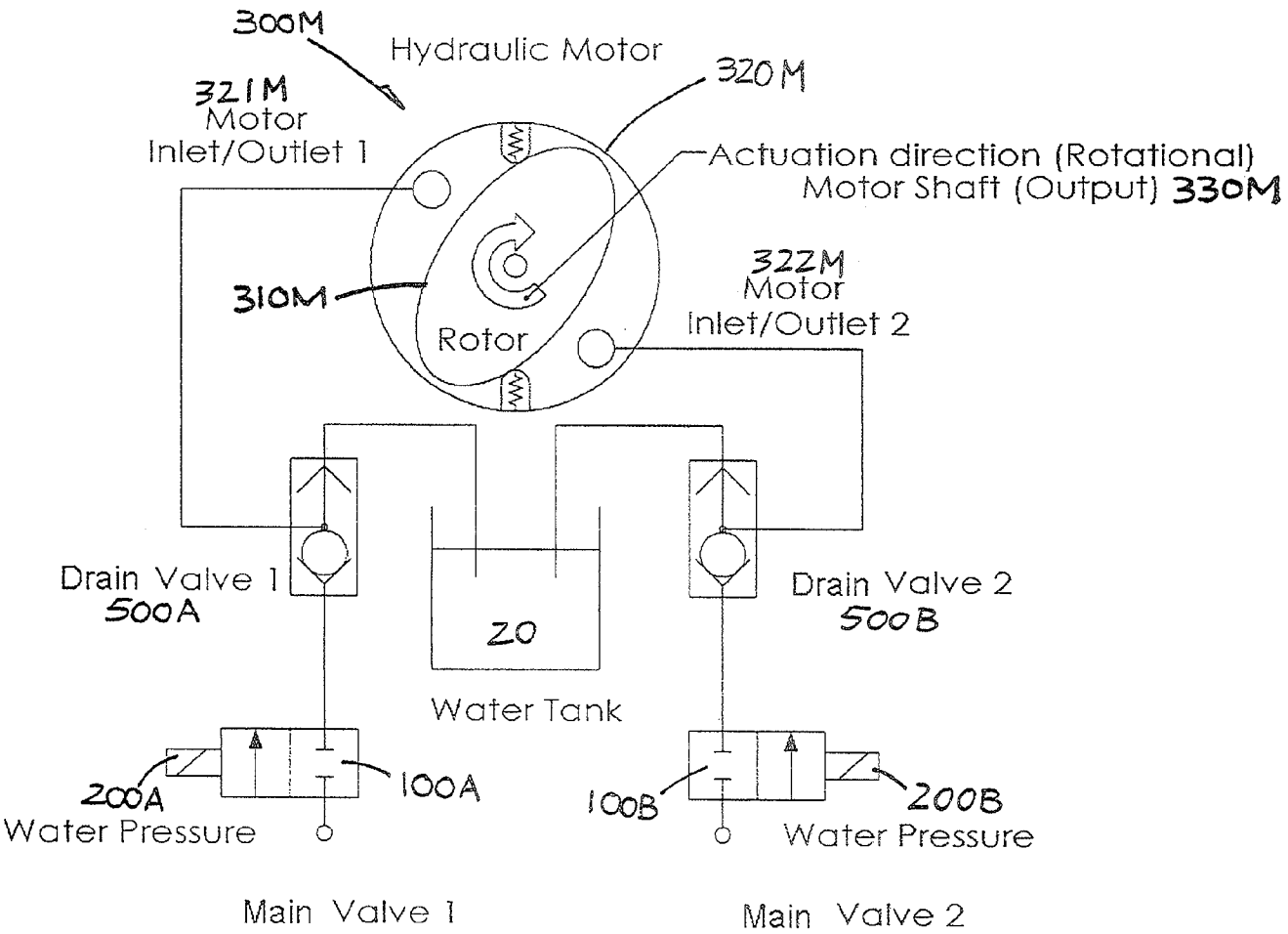
FIG. 24 is a schematic circuit diagram of the fluid-operated actuator assembly including the hydraulic motor of FIG. 22A.

The majority of the other components of the actuator assembly 10 as described above remain usable, but two sets of such components are installed, the first set for opening the lid 50 and the second set for closing (FIGS. 23 and 24). The two sets of components are denoted by the same reference numerals as used above but with a suffix "A" for the first set and suffix "B" for the second set, e.g. main valve 100A, latching solenoid 200A and shuttle valve 500A for opening the lid 50, and main valve 100B, latching solenoid 200B and shuttle valve 500B for closing the lid 50.

The hydraulic actuator 300C/300M may have to be detached from such other components, or its orientation changed, to allow for the nature and/or direction of its drive output vis-à-vis the gear train 70.

In the case of a hydraulic cylinder 300C being used, it has generally the same structure as the earlier hydraulic cylinder 300 with equivalent parts designated by the same reference numerals suffixed by a letter "C". The front chamber 322C does not have an equivalent of the aforesaid slot 323, as it is utilized in the same manner as the rear chamber 321C but in conjunction with the extra second set of components including the main valve 100B, latching solenoid 200B and shuttle valve 500B (FIG. 23) for closing the lid 50.

Thus, pressurized water in the rear chamber 321C pushes the piston 310C forward to open the lid 50 and, in the subsequent operation, water in the front chamber 322C pushes the piston 310C backward to close the lid 50. The hydraulic cylinder 300C is reversible in operation to accomplish the opening and closing actions upon the lid 50 in opposite directions.

To apply the linear driving force from the hydraulic cylinder 300C to turn the gear train 70, a crank-and-slider mechanism 65 (FIG. 21) is connected between the rod 330C of the cylinder 300C and the drive input axle 64 of the gear train 70, with a crank part 66 coupled with the axle 64 and a slider part 67 connected to the rod 3300. The cylinder 300C is hinged at the rear/bottom end of its housing 320C such that the cylinder 3000 is pivotable back and forth to permit the operation of the crank-and-slider mechanism 65.

In the case of a hydraulic motor 300M being used, it has a housing 320M with a cylindrical interior, a piston 310M supported co-axially in the housing 320M for angular movement i.e. rotation about a central axis (hence also known as rotor), and a central shaft 330M extending from the piston or rotor 310M out of the front end of the housing 320M. The rotor 310M has a number of corner parts known as vanes which divide the interior of the housing 320M into a number of (moving) chambers or compartments which, depending on the relative angular position of the rotor 310M, are in communication with the exterior via a first input/output port 321M and a second input/output port 322M. A pinion 331M fitted on the shaft 330M, which is in mesh with the gear 77, outputs rotational drive to the gear train 70.

The first set of components, including the main valve 100A, latching solenoid 200A and shuttle valve 500A, are associated with the first input/output port 321M for delivering pressurized water into and out of the housing 320M via separate chambers thereof. In operation, force differential created by unbalanced force of the pressurized water on the vanes turns the rotor 310M in one direction, e.g. clockwise, for the shaft 330M to drive the gear train 70 to open the lid 50.

The second set of components, including the main valve 100B, latching solenoid 200B and shuttle valve 500B, are associated with the second input/output port 322M for delivering pressurized water into and out of the housing 320M via separate chambers thereof. In subsequent operation, reversed force differential created by unbalanced force of the pressurized water on the vanes turns the rotor 310M in the opposite anti-clockwise direction for the shaft 330M to drive the gear train 70 to close the lid 50.

The shaft 330M or the rotor 310M driving the shaft 330M is another example of the actuating member of the subject fluid-operated actuator assembly.

Overall, depending on which one of the input/output ports 321M and 322M is used for feeding pressurized water, the hydraulic motor 300M may be driven to rotate in opposite directions to accomplish both opening and closing actions upon the lid 50.

To apply the rotary driving force from the hydraulic motor 300M to turn the gear train 70, a speed-reduction gearbox (not shown) may be installed between the shaft 330M of the motor 300M and the axle 64 of the gear train 70.

In general, either one or both of the arms 32 may be equipped with a gear train 70 (i.e. gears 71 to 78 and axles 61 to 64) for drive transmission to open and close the lid 50 depending on the weight of the lid 50 or the torque required to support it. In future embodiments, a single central arm may be employed to operate the lid for a neat and balanced design. In addition, a similar pivoting mechanism may also be installed for lifting and lowering the seat 40 for a fully automated operation.

The fluid-operated actuator assembly, or the actuator in short, of the subject invention is powered by the pressurized water from a tap or flush water source. A bi-stable electromagnetic device, e.g. an electrical latching solenoid valve, is used to control the water flow from the water source. While the solenoid valve is opened, it lets in water which then triggers the actuator to operate the flushing valve, thereby letting water in the cistern to discharge immediately into the toilet bowl and flush away waste in the bowl. This arrangement utilizes the supply water pressure as the major power source to complete the toilet flushing operation.

The bi-stable electromagnetic device only requires an electrical signal of a limited duration to change state. Once latched, the latching solenoid will stay in the latched position without the need of electrical power, and hence no or very little electrical power is consumed or the power source may be turned off. Power consumption is therefore low and this enables use of battery power to control the actuator itself driven by pressurized water or fluid in general available in situ. Since the flushing mechanism is driven by the supply water pressure, the power consumption of the control electronics and latching solenoid is extremely low.

The invention makes it possible for a battery-operated toilet flushing system to function with a reasonable operating time before battery runs flat. By calculation, a battery cell can trigger over 30,000 times flushing cycles in 3.5 years of normal use.

In general, the fluid-operated actuator assembly of the subject invention could be powered by other forms of energy means instead of batteries, such as AC, hydro or solar power.

The invention has been given by way of example only, and various other modifications of and/or alterations to the described embodiments may be made by persons skilled in the art without departing from the scope of the invention as specified in the appended claims.

The invention claimed is:

1. A liquid-operated actuator assembly comprising:

a main valve having an inlet for receiving a liquid from a pressurized liquid source, and an outlet for flow of the liquid from the main valve when the main valve is open, wherein the main valve prevents the flow of the liquid from the inlet to the outlet when the main valve is closed;

a pilot valve of a smaller flow capacity than the main valve and in communication with the outlet of the main valve, wherein the pilot valve has respective open and closed states, the pilot valve, upon transitioning from the closed state to the open state causes the main valve to open, and the pilot valve, upon transitioning from the open state to the closed state, causes the main valve to close;

a bi-stable latching solenoid transitioning the pilot valve between the open state and the closed state in response to an electrical pulse and maintaining the pilot valve in the open state and in the closed state without consuming electricity;

an electronic control circuit for generating and applying electrical pulses to the bi-stable latching solenoid;

a hydraulic actuator in communication with the outlet of the main valve for receiving the liquid discharged from the main valve and comprising a housing into which the liquid may flow from the outlet of the main valve, and a piston slidably mounted within the housing and driven by the liquid received from the outlet of the main valve, wherein the piston includes a piston rod protruding outside of the housing and sliding along an axis in response to sliding of the piston within the housing, and the housing includes a chamber on a side of the piston and into which the liquid flowing from the outlet of the main valve flows when the main valve is open; and a spring-loaded shuttle valve communicating with the outlet of the main valve and selectively communicating the chamber with a drain of the liquid-operated actuator, wherein the spring-loaded shuttle valve, in a first state, communicates the chamber to the drain, the spring-loaded shuttle valve, in a second state, isolates the chamber from the drain, and the spring-loaded shuttle valve is urged, against the pressure of an internal spring, into and maintained in the second state only when the liquid is flowing from the outlet of the main valve, and is in the first state when the liquid is not flowing from the outlet of the main valve.

2. The liquid-operated actuator assembly as claimed in claim 1, wherein the chamber includes a pressure limiter for limiting pressure of the liquid received in the chamber and acting upon the piston.

3. The liquid-operated actuator assembly as claimed in claim 2, wherein the pressure limiter comprises an opening in the housing for flow of the liquid from the housing when the piston rod is extended from the housing.

4. The liquid-operated actuator assembly as claimed in claim 1, wherein the liquid received in the chamber flows through the chamber while exerting a non-static pressure upon the piston when the piston rod is extended from the housing.

5. The liquid-operated actuator assembly as claimed in claim 1, wherein the electronic control circuit is battery-operated.

6. A toilet including:

a body for holding water for flushing the toilet;

a flushing mechanism comprising a flushing valve located at a bottom of the body for flushing water held in the body upon lifting of the flushing valve from the bottom of the body;

a liquid-operated actuator assembly mounted at an upper part of the body, higher than the flushing valve;

a hinged bracket pivotally mounted at a first end with respect to the liquid-operated actuator assembly and pivoted at a second end; and a flexible strand connecting the second end of the hinged bracket to a top of the flushing valve, wherein the liquid-operated actuator assembly comprises a main valve having an inlet for receiving a liquid from a pressurized liquid source, and an outlet for flow of the liquid from the main valve when the main valve is open, wherein the main valve prevents the flow of the liquid from the inlet to the outlet when the main valve is closed;

a pilot valve of a smaller flow capacity than the main valve and in communication with the outlet of the main valve, wherein the pilot valve has respective open and closed states, the pilot valve, upon transitioning from the closed state to the open state causes the main valve to open, and the pilot valve, upon transitioning from the open state to the closed state, causes the main valve to close;

a bi-stable latching solenoid transitioning the pilot valve between the open state and the closed state in response to an electrical pulse and maintaining the pilot valve in the open state and in the closed state without consuming electricity;

an electronic control circuit for generating and applying electrical pulses to the bi-stable latching solenoid;

a hydraulic actuator in communication with the outlet of the main valve for receiving the liquid discharged from the main valve and comprising a housing into which the liquid may flow from the outlet of the main valve, and a piston slidably mounted within the housing and driven by the liquid received from the outlet of the main valve, wherein the piston includes a piston rod protruding outside of the housing and sliding along an axis in response to sliding of the piston within the housing, the second end of the hinged bracket is pivoted by sliding of the piston rod outwardly from the housing, the flushing valve is lifted by sliding of the piston rod outwardly from the housing, and the housing includes a chamber on a side of the piston and into which the liquid flowing from the outlet of the main valve flows when the main valve is open; and a spring-loaded shuttle valve communicating with the outlet of the main valve and selectively communicating the chamber with a drain of the liquid-operated actuator, wherein the spring-loaded shuttle valve, in a first state, communicates the chamber to the drain, the spring-loaded shuttle valve, in a second state, isolates the chamber from the drain, and the spring-loaded shuttle valve is urged, against the pressure of an internal spring, into and maintained in the second state only when the liquid is flowing from the outlet of the main valve, and is in the first state when the liquid is not flowing from the outlet of the main valve.

7. The toilet as claimed in claim 6, including a toilet bowl to which the body is coupled.

8. A toilet including:

a toilet bowl;

a lid for covering and uncovering the toilet bowl;

a connecting member having a first end pivotally connected to the lid and a second end pivotally connected to the toilet bowl for movement of the lid between a closed position covering the toilet bowl, and an open position uncovering the toilet bowl:

a gear train including a plurality of gears and axles on which the gears are mounted, wherein the gear train is located within the connecting member, a first gear of the gear train is fixed to a first axle that engages the lid and a second gear of the gear train is fixed to a second axle;

a timing belt within the connecting member and engaging the first and second axles;

a liquid-operated actuator assembly pivotally mounted to the toilet bowl and including a crank and a slider, wherein the slider is pivotally connected to the crank, and the liquid-operated actuator assembly comprises a main valve having an inlet for receiving a liquid from a pressurized liquid source, and an outlet for flow of the liquid from the main valve when the main valve is open, wherein the main valve prevents the flow of the liquid from the inlet to the outlet when the main valve is closed;

a pilot valve of a smaller flow capacity than the main valve and in communication with the outlet of the main valve, wherein the pilot valve has respective open and closed states, the pilot valve, upon transitioning from the closed state to the open state causes the main valve to open, and the pilot valve, upon transitioning from the open state to the closed state, causes the main valve to close;

a bi-stable latching solenoid transitioning the pilot valve between the open state and the closed state in response to an electrical pulse and maintaining the pilot valve in the open state and in the closed state without consuming electricity;

an electronic control circuit for generating and applying electrical pulses to the bi-stable latching solenoid;

a hydraulic actuator in communication with the outlet of the main valve for receiving the liquid discharged from the main valve and comprising a housing into which the liquid may flow from the outlet of the main valve, and a piston slidably mounted within the housing and driven by the liquid received from the outlet of the main valve, wherein the piston includes a piston rod protruding outside of the housing and sliding along an axis in response to sliding of the piston within the housing, the slider is attached to the piston rod for sliding of the piston rod within the slider during extension and retraction of the piston rod with respect to the housing, the crank engages the second shaft for moving the lid between the closed and open positions upon extension and retraction of the piston rod, which rotates the second axle and the second gear, and, through the timing belt, rotates the first gear and the first axle, whereby the lid is respectively opened and closed by the liquid-operated actuator assembly, and the housing includes a chamber on a side of the piston and into which the liquid flowing from the outlet of the main valve flows when the main valve is open; and a spring-loaded shuttle valve communicating with the outlet of the main valve and selectively communicating the chamber with a drain of the liquid-operated actuator, wherein the spring-loaded shuttle valve, in a first state, communicates the chamber to the drain, the spring-loaded shuttle valve, in a second state, isolates the chamber from the drain, and the spring-loaded shuttle valve is urged, against the pressure of an internal spring, into and maintained in the second state only when the liquid is flowing from the outlet of the main valve, and is in the first state when the liquid is not flowing from the outlet of the main valve.

9. The toilet as claimed in claim 8, wherein the first shaft is fixed to the lid so that in moving the lid to the open position the lid is rotated relative to the connecting member and, in the open position, an underside of the lid faces away from a user seated on the toilet bowl.

* * * * *